US010908556B2

(12) United States Patent
Koike

(10) Patent No.: US 10,908,556 B2
(45) Date of Patent: Feb. 2, 2021

(54) TIMEPIECE MOVEMENT AND TIMEPIECE

(71) Applicant: Seiko Epson Corporation, Tokyo (JP)

(72) Inventor: Nobuhiro Koike, Chino (JP)

(73) Assignee: Seiko Epson Corporation

( * ) Notice: Subject to any disclaimer, the term of this patent is extended or adjusted under 35 U.S.C. 154(b) by 313 days.

(21) Appl. No.: 16/137,875

(22) Filed: Sep. 21, 2018

(65) Prior Publication Data

US 2019/0094807 A1 Mar. 28, 2019

(30) Foreign Application Priority Data

Sep. 25, 2017 (JP) ..... 2017-184150

(51) Int. Cl.
*G04B 19/22* (2006.01)
*G04B 19/253* (2006.01)
*G04B 27/00* (2006.01)

(52) U.S. Cl.
CPC ..... *G04B 19/221* (2013.01); *G04B 19/22* (2013.01); *G04B 19/25373* (2013.01); *G04B 19/25393* (2013.01); *G04B 27/005* (2013.01)

(58) Field of Classification Search
CPC ..... G04B 19/22; G04B 19/221; G04B 19/24; G04B 19/253; G04B 19/25373; G04B 19/25393; G04B 27/005
See application file for complete search history.

(56) References Cited

U.S. PATENT DOCUMENTS 7,706,214 B2 * 4/2010 Scheufele ..... G04B 19/2536 368/38
7,717,616 B2 * 5/2010 Bron ..... G04B 27/005 368/192
2005/0128875 A1 6/2005 Bron
(Continued)

FOREIGN PATENT DOCUMENTS

CH 685 965 B5 5/1996
CH 710 118 A2 3/2016
JP H06-265645 A 9/1994
(Continued)

OTHER PUBLICATIONS

Extended European Search Report for Application No. EP 18 19 5948 dated Mar. 27, 2019 (5 pages).

*Primary Examiner* — Edwin A. Leon
*Assistant Examiner* — Jason M Collins
(74) *Attorney, Agent, or Firm* — Harness, Dickey & Pierce, P.L.C.

(57) ABSTRACT

A timepiece movement includes: an hour wheel and pinion; a minute wheel and pinion; a winding stem; a time difference correction train; a date indicator; and a date change mechanism. The hour wheel and pinion includes an hour wheel that rotates with the minute wheel and pinion, an hour jumper, an hour jumper pinion, and an hour wheel body that turns with the hour wheel via the hour jumper and hour jumper pinion, and turns with the time difference correction train. The date change mechanism includes a date change wheel that turns
(Continued)

with the hour wheel body, a date change lever, a date change cam that flexes the date change lever by rotating with the date change wheel, and turns in response to the flexed date change lever spring force, and a date change pawl that rotates with the date change cam, and advances the date indicator.

7 Claims, 14 Drawing Sheets

(56) References Cited

U.S. PATENT DOCUMENTS

2014/0321247 A1 10/2014 Cattaneo et al.

FOREIGN PATENT DOCUMENTS

| | | | |
|---|---|---|---|
| JP | H09-090061 | A | 4/1997 |
| JP | 2005-181323 | A | 7/2005 |
| JP | 2014-020799 | A | 2/2014 |
| JP | 2014-525574 | A | 9/2014 |
| JP | 2016-057269 | A | 4/2016 |
| JP | 2016-057270 | A | 4/2016 |

* cited by examiner

TIMEPIECE MOVEMENT AND TIMEPIECE

BACKGROUND

1. Technical Field

The present invention relates to a timepiece movement and a timepiece.

2. Related Art

JP-A-2016-57269 describes a timepiece that has a time difference correction mechanism for adjusting the hour indicated by the hour hand when adjusting the time difference as a result of moving to a different time zone.

In the timepiece taught in JP-A-2016-57269, the hour wheel complete includes the hour wheel (first wheel) that turns in conjunction with the minute wheel, an hour jumper pinion (star wheel) that rotates in unison with the hour wheel, an hour jumper that engages the hour jumper pinion, and an hour wheel body (cylinder) that rotates in unison with the hour jumper. Thus comprised, the hour wheel body turns in conjunction with the hour wheel. The hour wheel body also turns in conjunction with the time difference correction train, which turns in conjunction with the winding stem.

When the winding stem is turned to drive the time difference correction train and turn the hour wheel body in this timepiece, rotation of the hour wheel is restricted by the minute wheel, the hour jumper bends, and the hour jumper pinion and hour jumper disengage. As a result, the hour wheel body turns while the hour wheel remains stationary, and the hour indicated by the hour hand can be adjusted.

However, some timepieces having a date indicator also have a date jumper mechanism (also referred to as a quick set date mechanism) that instantly jumps the date indicated by the date indicator when adjusting the date. Providing such a quick set date mechanism in a timepiece with a time difference correction mechanism is also desirable.

SUMMARY

An objective of the present invention is to provide a timepiece movement and a timepiece enabling both adjusting the time difference and instantly changing the calendar.

A timepiece movement according to one aspect of the invention includes: an hour wheel and pinion; a minute wheel and pinion; a winding stem; a time difference correction train configured to rotate in conjunction with the winding stem; a date indicator; and a date change mechanism configured to turn the date indicator. The hour wheel and pinion includes an hour wheel configured to rotate in conjunction with the minute wheel and pinion; an hour jumper; an hour jumper pinion that engages the hour jumper; and an hour wheel body to which an hour hand attaches, the hour wheel body configured to turn in conjunction with the hour wheel through the hour jumper and hour jumper pinion, and turn in conjunction with the time difference correction train. The date change mechanism includes a date change wheel configured to turn in conjunction with the hour wheel body; a date change lever; a date change cam configured to contact the date change lever, flex the date change lever by rotating in conjunction with the date change wheel, and turn in response to spring force of the flexed date change lever; and a date change pawl configured to rotate in unison with the date change cam, and advance the date indicator when the date change cam turns in response to the spring force.

The date indicator may be a date indicator or a day indicator, for example.

When the hour wheel body turns in conjunction with the minute wheel and pinion in this configuration, the date change wheel turns in conjunction with the hour wheel body, and the date change cam turns in conjunction with the date change wheel. As a result, the date change lever gradually flexes. When the date change cam turns to a specific position, the spring force of the flexed date change lever causes the date change cam to turn instantly. At this time, the date change pawl that turns in unison with the date change cam advances the date indicator.

A timepiece with the time difference correction function according to this configuration can instantly advance the calendar.

In addition, because the calendar change wheel turns in conjunction with the hour wheel body, the calendar can also be simultaneously adjusted by operating the winding stem to turn the time difference correction train and turn the hour wheel body instead of just adjusting the hour indicated by the hour hand. As a result, user convenience can be improved compared with a configuration in which adjusting the hour and adjusting the calendar are separate operations.

In a timepiece movement according to another aspect of the invention, the hour jumper flexes perpendicularly to the axis of rotation of the hour wheel and pinion, and the thickness of the hour jumper along the axis of rotation of the hour wheel and pinion is greater than the thickness of the hour wheel along the axis of rotation.

Compared with a configuration in which the thickness of the hour jumper is the same as the thickness of the hour wheel, this configuration can suppress bending of the hour jumper in the direction perpendicular to the flexing direction. More specifically, twisting of the hour jumper can be suppressed. As a result, spring force in the flexing direction of the hour jumper can be stabilized.

In a timepiece movement according to another aspect of the invention, the date change mechanism preferably includes an intermediate wheel train with at least one wheel that rotates in conjunction with the hour wheel body; and the date change wheel turns in conjunction with the hour wheel body through the intermediate wheel train.

Compared with a configuration in which the hour wheel body meshes directly with the date change wheel, this configuration increases the number of meshing teeth, and can therefore more easily absorb the force of impact when a sudden shock is applied to the timepiece movement. As a result, shifting of the positions of the hour wheel body and date change wheel when such a force is applied can be suppressed. In addition, the direction of rotation of the date change wheel relative to the direction of rotation of the hour wheel body, and the position of the date change wheel relative to the hour wheel body, can be adjusted.

Further preferably in a timepiece movement according to another aspect of the invention, at least one wheel of the intermediate wheel train, and at least one wheel of the time difference correction train, are the same wheel.

Compared with a configuration in which all wheels of the intermediate wheel train and all wheels of the time difference correction train are separate wheels, this configuration reduces the number of wheels and reduces the parts count.

Further preferably, a timepiece movement according to another aspect of the invention also has a main plate, and a calendar plate disposed on the face side of the main plate, with the hour wheel and pinion being disposed on the face side of the main plate, and the date change wheel being disposed on the face side of the calendar plate.

Compared with a configuration in which the date change wheel is also disposed on the face side of the main plate like the hour wheel and pinion, this configuration simplifies positioning the date change wheel in the direction perpendicular to the main plate, and suppresses variation in the position in the axial direction.

Another aspect of the invention is a timepiece having the timepiece movement described above, and an hour hand.

This configuration improves timepiece usability because the timepiece can instantly advance the calendar, and the calendar can be simultaneously adjusted when correcting the time difference instead of just changing the hour indicated by the hour hand.

A timepiece according to another aspect of the invention also has a dial with a date window; the calendar or date indicator is a date wheel; and the number on the date wheel visible through the date window is advanced instantly by the date change mechanism.

This configuration enables the user to reliably see the date on the date indicator in the date window immediately before and after the date changes at 12:00 p.m.

Other objects and attainments together with a fuller understanding of the invention will become apparent and appreciated by referring to the following description and claims taken in conjunction with the accompanying drawings.

DESCRIPTION OF EMBODIMENTS

A preferred embodiment of the present invention is described below with reference to the accompanying figures.

Timepiece Configuration

Figure 1:
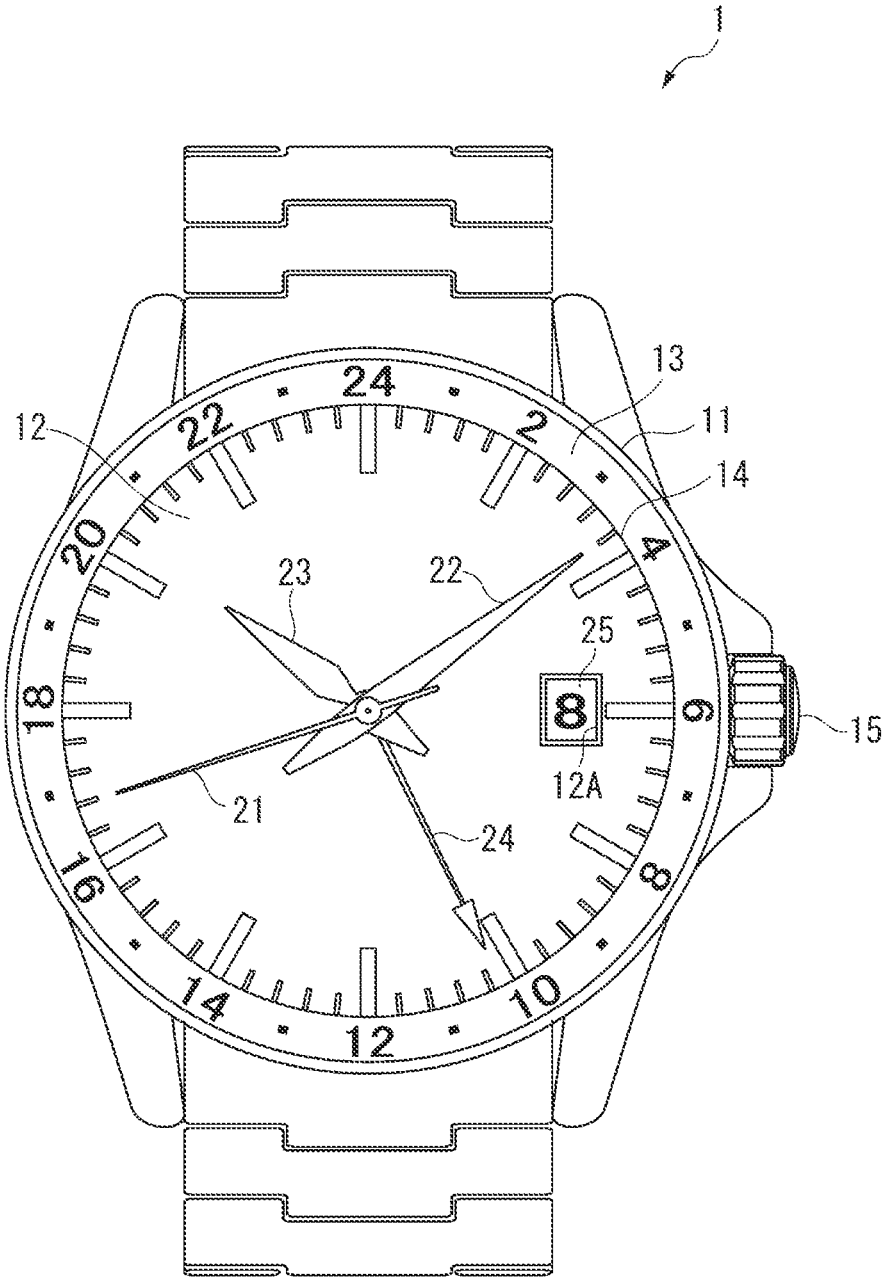
FIG. 1 is a plan view of a timepiece according to the invention.

FIG. 1 is a plan view of an electronic timepiece 1 according to the invention.

The timepiece 1 has a round external case 11, and a round dial 12 disposed inside the external case 11. Of the two open sides of the external case 11, the opening on the face side of the timepiece (referred to below as simply the face side) is closed by a crystal 14 held by a round bezel 13, and the opening on the back side of the timepiece (referred to below as simply the back side) is closed by a back cover not shown. The external case 11 and back cover embody the case of the timepiece 1.

Inside the case the timepiece 1 also includes a movement 2 (see FIG. 2, FIG. 3), second hand 21, minute hand 22, hour hand 23, 24-hour hand 24, and date indicator 25 as a calendar wheel. The hands 21 to 24 are attached to coaxially disposed arbors (pivots) 411, 421, 741, 451 (see FIG. 4) that are included in the movement 2 and driven by the movement 2.

By the 24-hour hand 24 pointing to a 24-hour marker disposed to the bezel 13, this timepiece 1 can indicate the hour of a time in a different time zone than the time zone of the time indicated by the hour hand 23. For example, when travelling to a foreign country, the hour of the local time in the current time zone may be indicated by the hour hand 23 while the hour of the time in Japan is indicated by the 24-hour hand 24.

The dial 12 also has a date window 12A, and numbers on the date indicator 25 can be seen through the date window 12A. The numbers on the date indicator 25 indicate the day value of the year-month-day date.

On the side of the external case 11 is disposed a crown 15, which is attached to the winding stem 39 (see FIG. 6) of the movement 2 and is operated to adjust the time and date.

Configuration of the Movement

Figure 2:
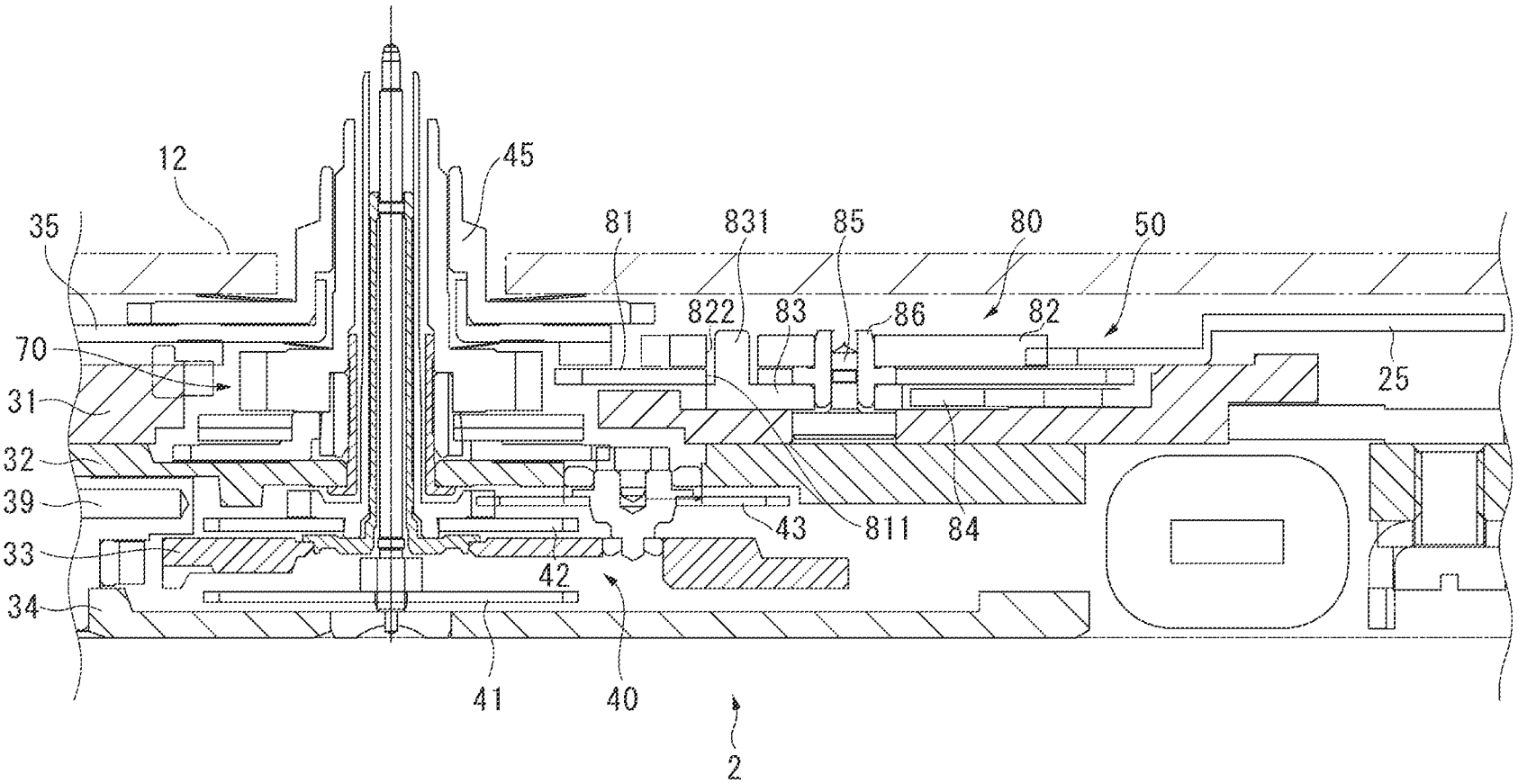
FIG. 2 is a section view of the movement according to a preferred embodiment of the invention.
Figure 3:
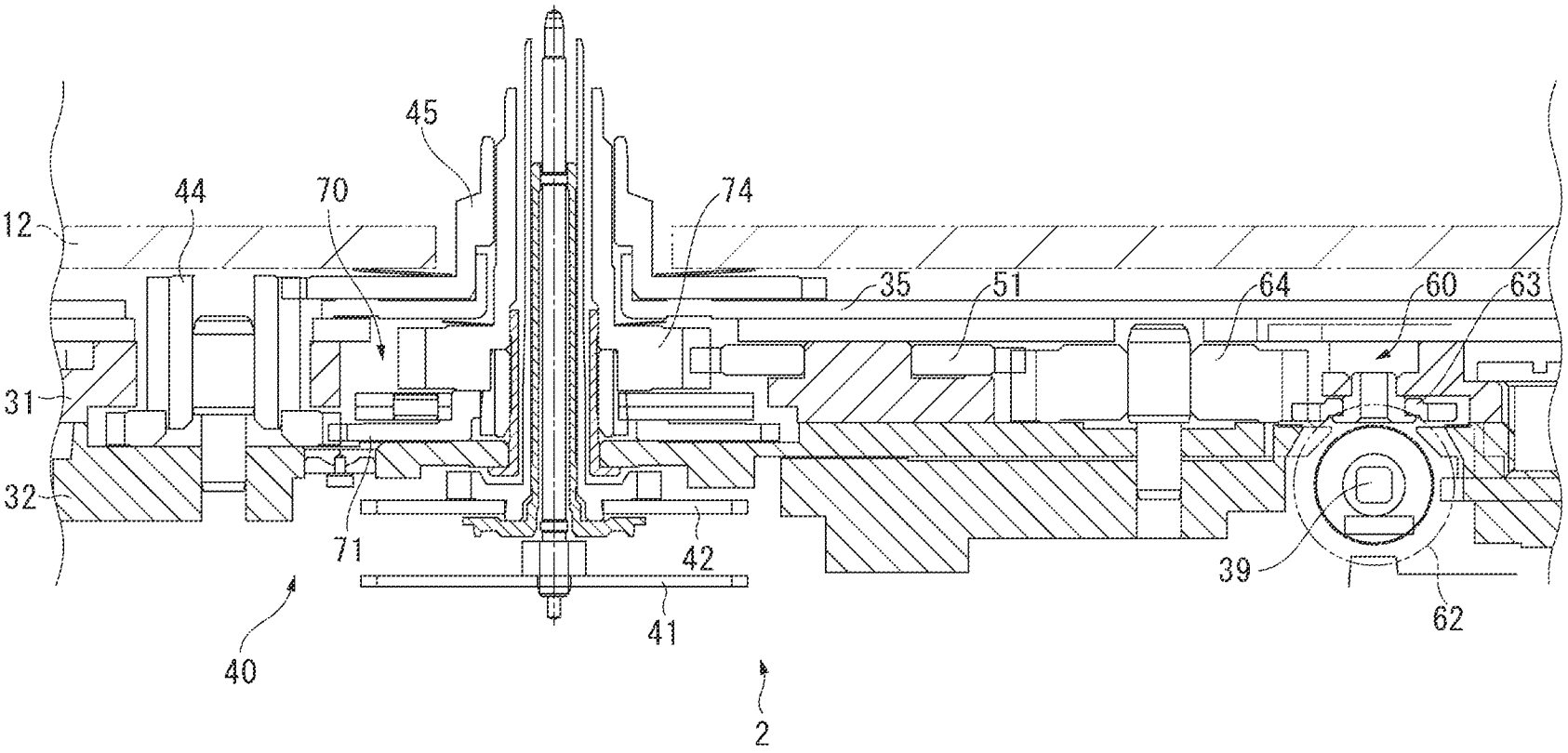
FIG. 3 is a section view of the movement according to a preferred embodiment of the invention.
Figure 4:
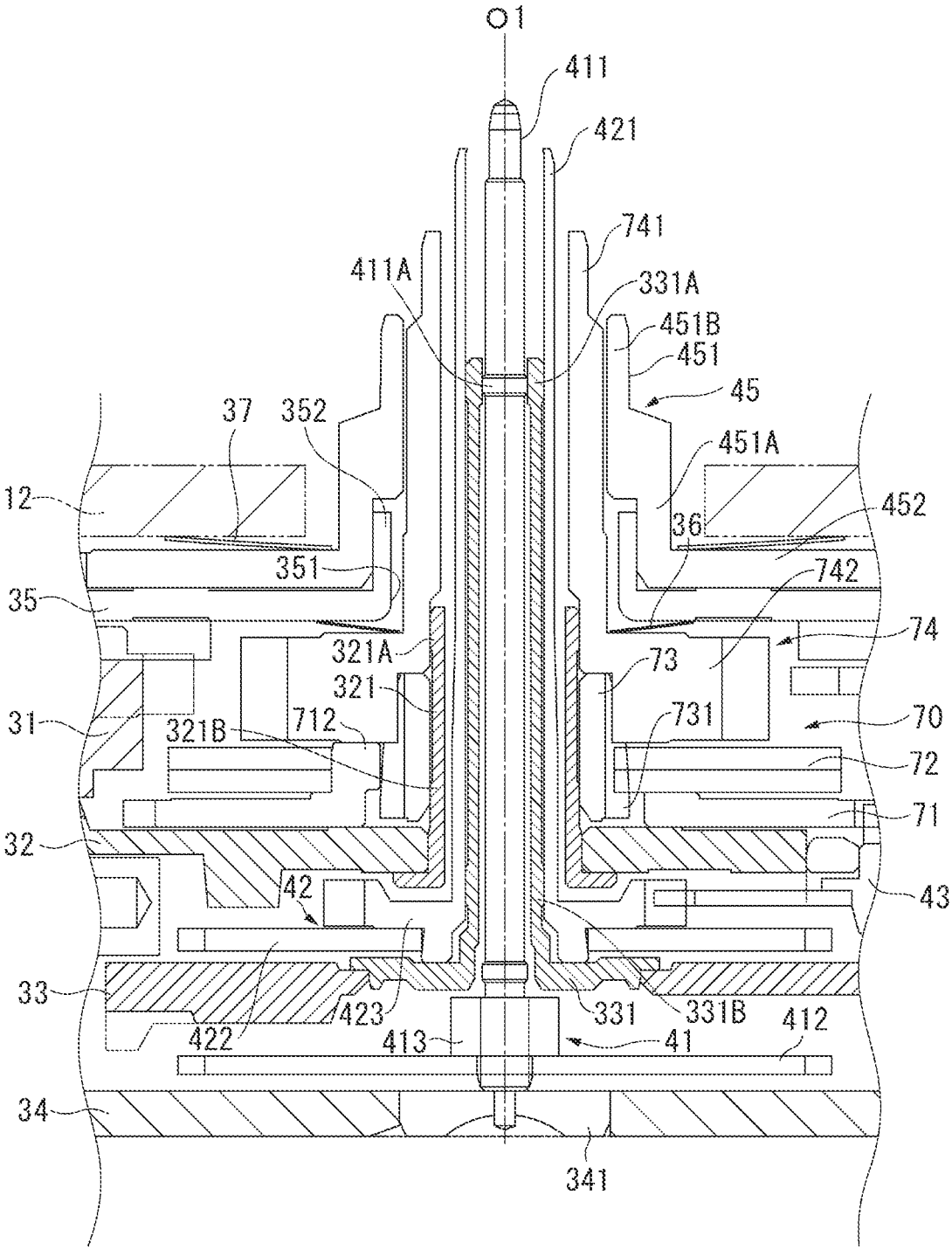
FIG. 4 is an enlarged view of part of FIG. 3.

FIG. 2 and FIG. 3 are section views of the movement 2, and FIG. 4 is an enlarged view of part of FIG. 2.

As shown in FIG. 2 and FIG. 3, the movement 2, which is a timepiece movement, has in order from the dial 12 to the back cover, a calendar plate 31, main plate 32, center wheel bridge 33 (minute wheel bridge), and wheel train bridge 34.

The winding stem 39 to which the crown 15 is attached is also incorporated in the movement 2. The winding stem 39 can be pulled out in the axial direction to two stops from the zero stop position (the position when pushed all the way in).

The movement 2 also includes a wheel train mechanism 40 for indicating the time (hour, minute, second), a date change mechanism 50 for displaying the date, and a time difference correction mechanism 60 for adjusting the time difference of the hour hand 23.

Configuration of the Wheel Train Mechanism

The wheel train mechanism 40 includes a fifth wheel (not shown in the figure), fourth wheel and pinion 41, third wheel and pinion (not shown in the figure), center wheel and pinion 42, minute wheel and pinion 43, hour wheel and pinion 70, 24-hour intermediate wheel and pinion 44, and 24-hour wheel and pinion 45.

Fourth Wheel and Pinion

As shown in FIG. 4, the fourth wheel and pinion 41 (second hand wheel and pinion) has a center pivot 411 (second hand pivot) to which the second hand 21 is attached, a fourth wheel 412 disposed to the center (fourth) pivot 411, and a fourth pinion 413. The fourth wheel 412 engages the fifth wheel, and the fourth pinion 413 engages the third wheel.

The back cover end of the center pivot 411 is guided by a hole stone 341 disposed to the wheel train bridge 34.

The crystal-side end of the center pivot 411 is between the crystal and the dial 12. A protruding part 411A that protrudes to the outside is disposed to the center pivot 411 at a position between the crystal and the dial 12.

A second arbor 331 (first guide) is disposed to the center wheel bridge 33. The second arbor 331 is tubular, and is disposed coaxially to the axis O1 of the center pivot 411. The crystal-side end of the second arbor 331 is located between the crystal and the dial 12, and has a guide member 331A that protrudes to both the inside and the outside. Another guide member 331B that protrudes to the outside is disposed to the second arbor 331 on the back cover side of the surface of the main plate 32.

The center pivot 411 is inserted to the second arbor 331, and the protruding part 411A of the center pivot 411 is guided by the guide member 331A of the second arbor 331. As a result, the center pivot 411 is guided (supported) by the second arbor 331.

The fourth wheel 412 and fourth pinion 413 are disposed between the wheel train bridge 34 and the center wheel bridge 33.

Center Wheel and Pinion Configuration

The center wheel and pinion 42 (minute hand wheel) includes an arbor 421 (minute hand pivot) to which the minute hand 22 is attached, and a second wheel 422 and second pinion 423 disposed to the arbor 421. The second wheel 422 engages the third wheel, and the second pinion 423 engages the minute wheel and pinion 43.

The arbor 421 is tubular with a diameter greater than the center pivot 411, and is disposed coaxially to the axis O1. The end of the arbor 421 on the back cover side is disposed between the center wheel bridge 33 and main plate 32 in the axial direction, and the end toward the crystal is between the crystal and the dial 12.

The center pivot 411 and second arbor 331 are inserted inside the arbor 421, and guide member 331A and guide member 331B of the second arbor 331 guide the inside surface of the arbor 421. The arbor 421 is thus guided by the second arbor 331.

The second wheel 422 and second pinion 423 are disposed between the center wheel bridge 33 and main plate 32.

Hour Wheel and Pinion Configuration

Figure 5:
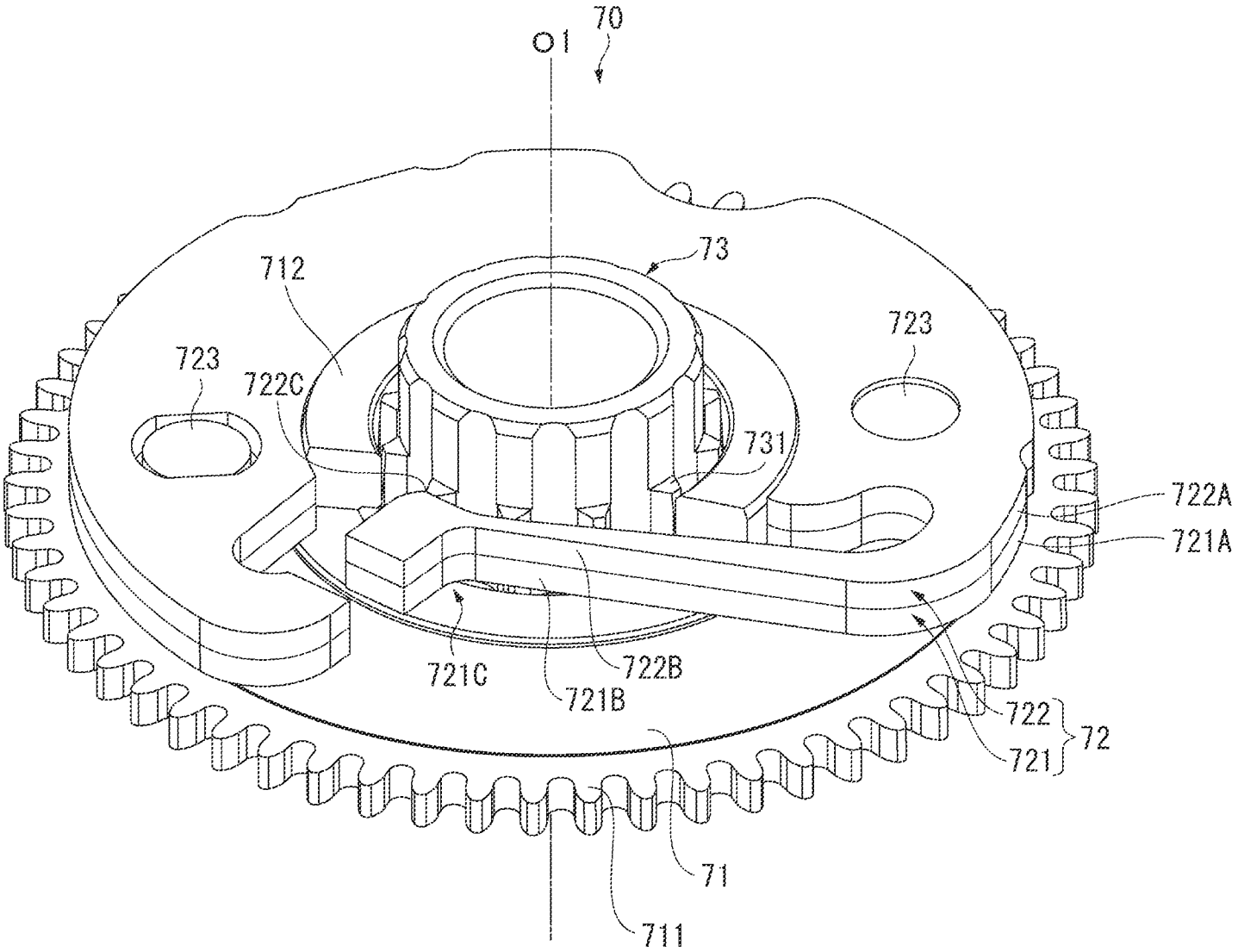
FIG. 5 is an oblique view of the hour wheel (not including the hour wheel body) according to a preferred embodiment of the invention.

FIG. 5 is an oblique view of the hour wheel and pinion 70 (hour hand wheel). Note that the hour wheel body 74 is not shown in FIG. 5.

As shown in FIG. 4 and FIG. 5, the hour wheel and pinion 70 includes, disposed on the face side of the main plate 32, the hour wheel 71, hour jumper 72, hour jumper pinion 73, and hour wheel body 74 (first date change intermediate wheel).

As shown in FIG. 4, the hour wheel body 74 has an arbor 741 that is cylindrical with a greater diameter than arbor 421 and is disposed coaxially to the axis O1, and a hour wheel body pinion 742 formed integrally to the arbor 741.

As shown in FIG. 4 and FIG. 5, the hour jumper pinion 73 is cylindrical with a diameter greater than the arbor 421 of the center wheel and pinion 42, and is disposed coaxially to the axis O1. The hour jumper pinion 73 is fit to the hour wheel body 74 from the back cover side, and rotates in unison with the hour wheel body 74. More specifically, the arbor 741 and hour jumper pinion 73 form the pivot (hour hand pivot) of the hour wheel and pinion 70. Twelve teeth 731 are disposed circumferentially around the outside surface of the hour jumper pinion 73. The hour jumper pinion 73 may also referred to as a star wheel.

The hour wheel 71 has an annular shape around the outside surface of the hour jumper pinion 73, and teeth 711 that mesh with the minute wheel and pinion 43 and the 24-hour intermediate wheel and pinion 44 (see FIG. 3) are formed around the outside surface of the hour wheel 71. An arc member 712, which forms an arc when seen from the face side, is disposed protruding from the inside circumference edge to the face side of the hour wheel 71. The arc member 712 encloses at least half of the outside circumference of the hour jumper pinion 73.

The hour jumper 72 is disposed to the face side of the hour wheel 71. More specifically, as described further below, to increase the torque of the hour jumper 72, the hour jumper 72 comprises two hour jumper members 721, 722 stacked together in the axial direction. The hour jumper members 721, 722 in this example are formed in a stamping process.

Hour jumper member 721 forms an arc centered on the axis O1 when seen from the face side, and comprises an hour jumper member body 721A, and a flexible pawl arm 721B extending from the circumferential end of the hour jumper member body 721A. A pawl 721C that engages the teeth 731 of the hour jumper pinion 73 is disposed to the distal end of the pawl arm 721B, and the pawl arm 721B flexes in the direction away from the hour jumper pinion 73.

Hour jumper member 722 has the same shape as hour jumper member 721 in plan view, and the same size and thickness, and like hour jumper member 721 has an hour jumper member body 722A that is guided by the arc member 712, and a pawl arm 722B with a pawl 722C that engages the teeth 731 of the hour jumper pinion 73.

When seem from the face side, hour jumper member 722 is disposed to the same rotational position as hour jumper member 721, and is coincident with the hour jumper member 721.

Hour jumper member bodies 721A, 722A are fastened to the hour wheel 71 by two fastener pins 723, and the hour jumper 72 turns in unison with the hour wheel 71. Note that the fastener pins 723 may be formed in unison with the hour wheel 71.

As shown in FIG. 4, a center pipe 321 (second guide) is disposed to the main plate 32. The center pipe 321 is tubular, and disposed coaxially to the axis O1. The center pivot 411 of the fourth wheel and pinion 41, second arbor 331, and the arbor 421 of the center wheel and pinion 42 are inserted to the center pipe 321. The crystal-side end of the center pipe 321 is positioned between the crystal and the back cover side of the date indicator bridge 35 described below. The crystal side end of the center pipe 321 forms a guide 321A extending toward the outside. Another guide 321B extending toward the outside is disposed to the back cover side of the center pipe 321 from the guide 321A.

The center pivot 411, second arbor 331, arbor 421, and center pipe 321 are inserted to the arbor 741 of the hour wheel body 74 and the hour jumper pinion 73, the guide 321A of the center pipe 321 guides the inside surface of the arbor 741, and the guide 321B of the center pipe 321 guides the inside surface of the hour jumper pinion 73. The hour wheel and pinion 70 is thus guided by the center pipe 321.

When the minute wheel and pinion 43 turns in conjunction with rotation of the rotor, the hour wheel 71 and hour jumper 72 of the hour wheel and pinion 70 configured as described above also turn in conjunction with the minute wheel and pinion 43. Because the pawls 721C, 722C push against the hour jumper pinion 73 at this time, the pawls 721C, 722C engage the teeth 731 of the hour jumper pinion 73 and the hour jumper pinion 73 turns in conjunction with the hour jumper 72. The hour wheel body 74 also turns in unison with the hour jumper pinion 73.

When the hour wheel body 74 is turned by the time difference correction mechanism 60 described below, the hour jumper pinion 73 also turns in unison with the hour wheel body 74. Because rotation of the hour jumper 72 is limited by the minute wheel and pinion 43 meshed with the hour wheel 71 at this time, the pawl arms 721B, 722B are pushed by the teeth 731 of the hour jumper pinion 73 and flex, and the pawls 721C, 722C and teeth 731 separate. As a result, the hour wheel body 74 can be turned while the hour jumper 72 remains stationary.

Figure 6:
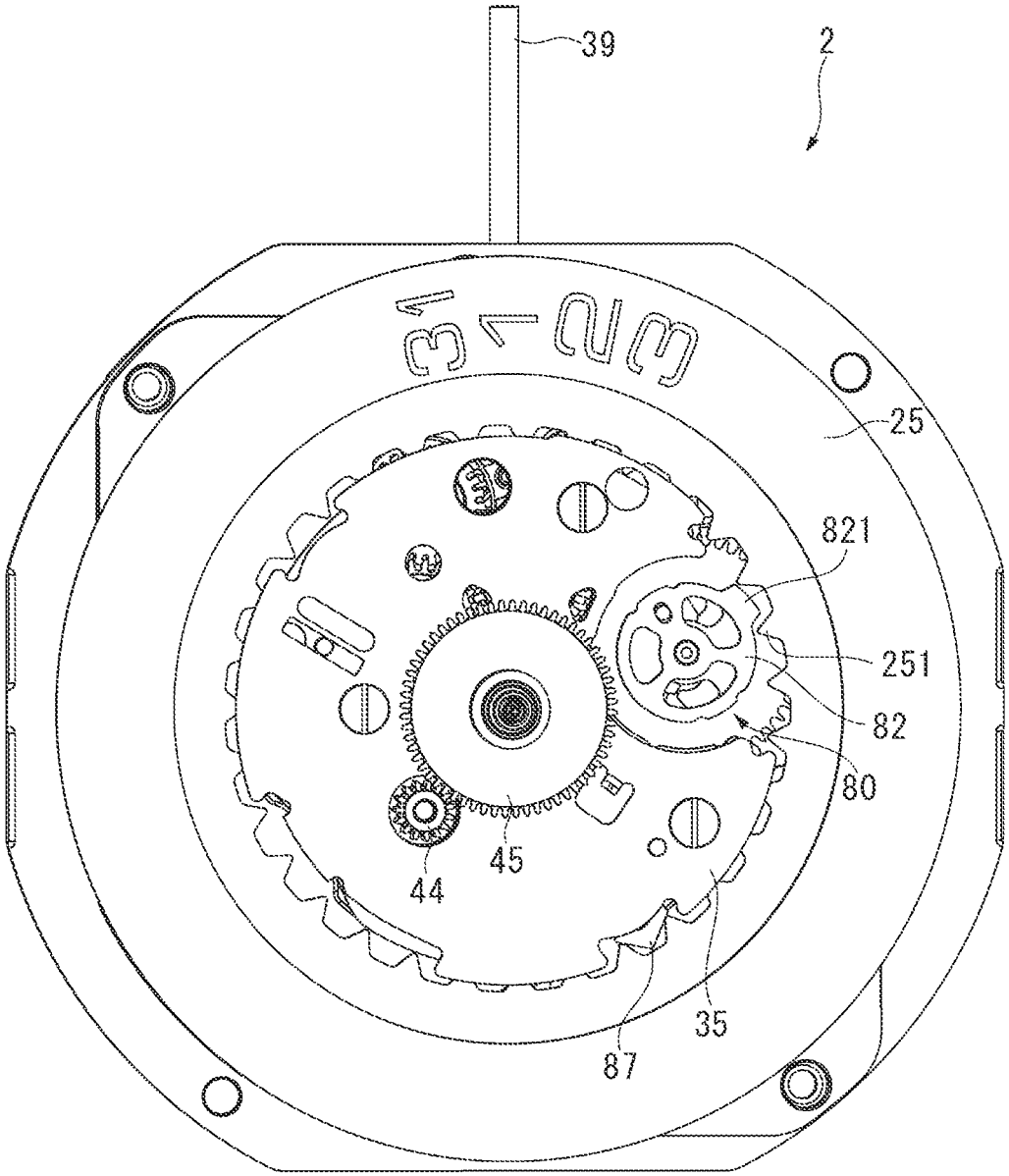
FIG. 6 is a plan view of the movement according to a preferred embodiment of the invention.

As shown in FIG. 6, the movement 2 has a date indicator bridge 35 that restricts circumferential movement of the date indicator 25. FIG. 6 is a plan view of the movement 2 from the face side.

As shown in FIG. 4, the date indicator bridge 35 is closer to the face than the hour wheel body pinion 742. The date indicator bridge 35 includes a round opening 351 coaxial to the axis O1, and a tubular portion 352 (third guide) extending toward the face from the outside edge of the opening 351. The tubular portion 352 is also coaxial to the axis O1. The center pivot 411, second arbor 331, arbor 421, and arbor 741 are inserted to the tubular portion 352. The distal end of the opening 351 is between the crystal and the back cover side of the dial 12.

An annular dial washer 36 (hour hand ring) is disposed between the hour wheel body pinion 742 and the date indicator bridge 35. The hour wheel and pinion 70 is urged to the main plate 32 by the dial washer 36.

In this embodiment of the invention, the part of the guide 321A that guides the hour wheel body 74 in the center pipe 321, and contact between the hour wheel body pinion 742 and the dial washer 36, are on the same plane perpendicular to the axial direction. As a result, the dial washer 36 urges the hour wheel and pinion 70 while also suppressing tilting of the hour wheel and pinion 70.

Configuration of the 24-Hour Wheel and Pinion

As shown in FIG. 4, the 24-hour wheel and pinion 45 (24-hour hand wheel) is tubular, and includes an arbor 451 (24-hour hand pivot) disposed coaxially to the axis O1, and a 24-hour wheel 452 formed in unison with the arbor 451. The 24-hour wheel 452 engages the 24-hour intermediate wheel and pinion 44 (see FIG. 3), and turns in conjunction with the hour wheel and pinion 70. The 24-hour wheel 452 turns one-half revolution for each revolution of the hour wheel and pinion 70.

The arbor 451 has a first tube 451A formed with a first diameter, and a second tube 451B disposed on the crystal side of the first tube 451A and having a second diameter that is smaller than the first diameter.

Inside the first tube 451A are inserted the center pivot 411 of the fourth wheel and pinion 41, the second arbor 331, the arbor 421 of the center wheel and pinion 42, the arbor 741 of the hour wheel body 74, and the tubular portion 352 of the date indicator bridge 35; and part of the tubular portion 352 (guide portion) guides the inside surface of the first tube 451A. The arbor 451 is thus guided by the tubular portion 352. Inside the second tube 451B are inserted the center pivot 411, the second arbor 331, arbor 421, and arbor 741.

The 24-hour wheel 452 is disposed between the date indicator bridge 35 and the dial 12.

An annular dial washer 37 (24-hour hand ring) is disposed between the 24-hour wheel 452 and dial 12. The 24-hour wheel and pinion 45 is urged to the date indicator bridge 35 by the dial washer 37.

In this embodiment, the part of the tubular portion 352 of the date indicator bridge 35 that guides the 24-hour wheel and pinion 45, and the point of contact between the 24-hour wheel 452 and the dial washer 37, are on the same plane perpendicular to the axial direction. As a result, the dial washer 37 urges the 24-hour wheel and pinion 45 while suppressing tilting of the 24-hour wheel and pinion 45.

Configuration of the Date Change Mechanism 50

Figure 7:
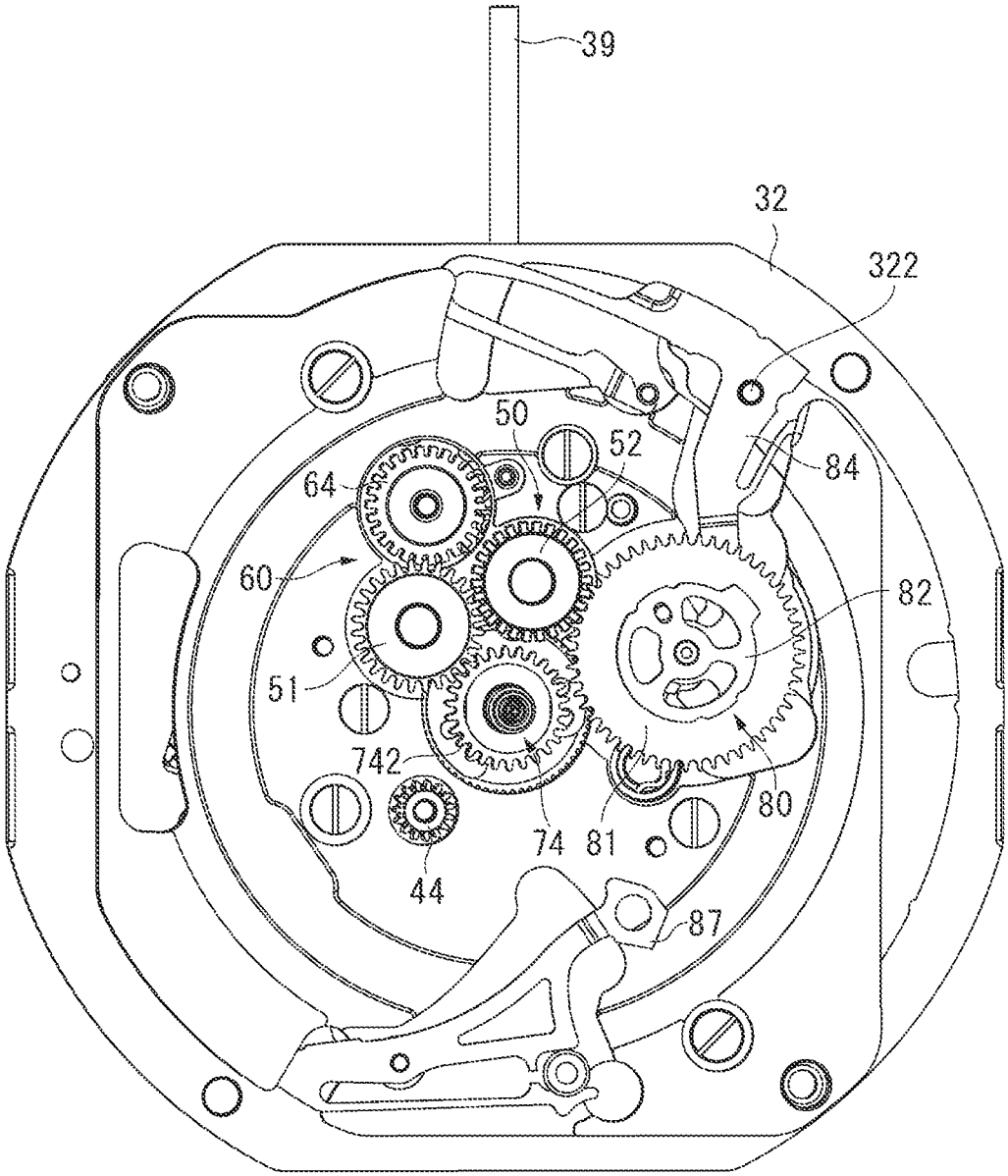
FIG. 7 is a plan view of the movement (not including the date indicator) according to a preferred embodiment of the invention.

FIG. 7 is a plan view from the face side of the movement 2 without the date indicator bridge 35, the date indicator guide, the date indicator 25, and the 24-hour wheel and pinion 45.

As shown in FIG. 7, the date change mechanism 50, also referred to as a calendar change mechanism, includes, disposed on the face side of the calendar plate 31 (see FIG. 2), a setting wheel 51, second date change intermediate wheel 52, and date indicator driver 80.

The setting wheel 51 engages the hour wheel body pinion 742 of the hour wheel body 74, and turns in conjunction with the hour wheel body 74. The second date change intermediate wheel 52 engages the setting wheel 51, and turns in conjunction with the setting wheel 51. The setting wheel 51 and second date change intermediate wheel 52 form an intermediate wheel train.

Configuration of the Date Change Mechanism

Figure 8:
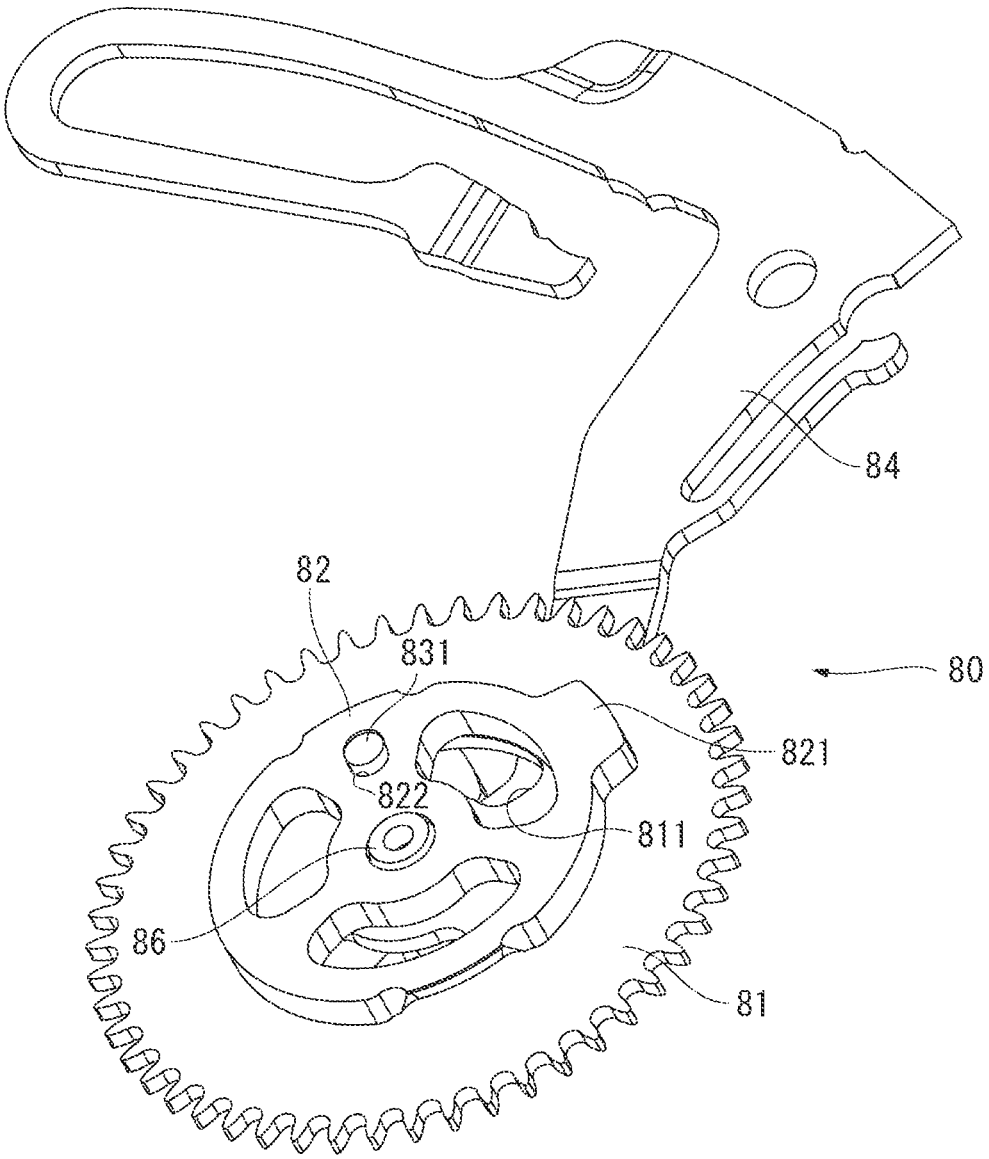
FIG. 8 is an oblique view of the date change mechanism from the face side of the timepiece according to a preferred embodiment of the invention.
Figure 9:
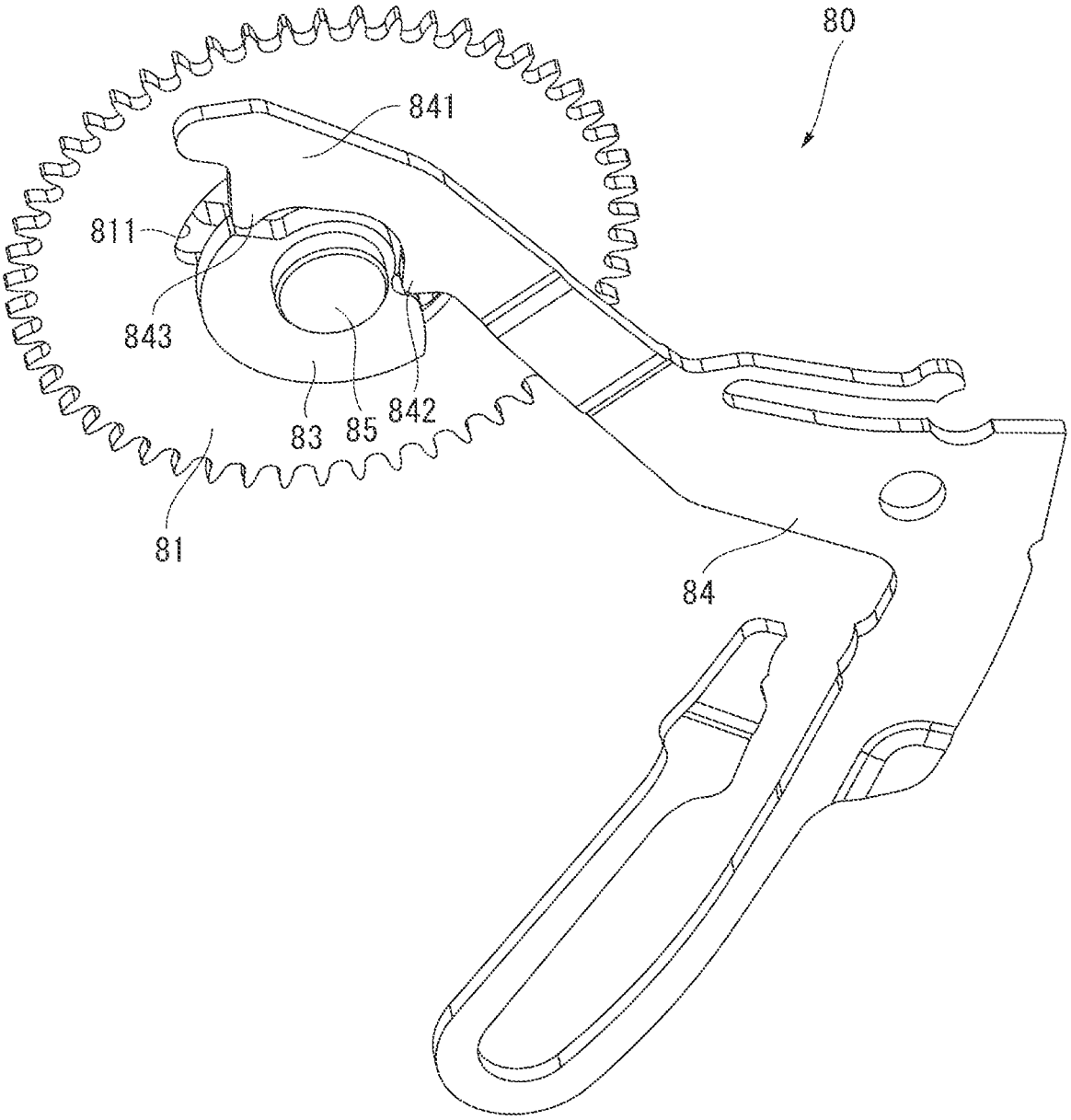
FIG. 9 is an oblique view of the date change mechanism from the back cover side of the timepiece according to a preferred embodiment of the invention.

FIG. 8 is an oblique view from the face side of the date indicator driver 80. FIG. 9 is an oblique view of the date indicator driver 80 from the back cover side.

As shown in FIG. 2, FIG. 8, and FIG. 9, the date indicator driver 80 includes a support 85 disposed to the calendar plate 31, an arbor 86 supported by the support 85, a date change wheel 81 attached rotatably to the arbor 86, a date change pawl disc 82 supported by and rotating in unison with the arbor 86, a date change cam 83, and a date change lever 84 that engages the date change cam 83. The date change lever 84 is axially supported on a pin 322 disposed to the main plate 32 (see FIG. 7), and positioned in the thickness direction by the calendar plate 31.

The date change wheel 81, also called a calendar change wheel, engages the second date change intermediate wheel 52, and rotates in unison with the second date change intermediate wheel 52. An arc-shaped opening 811 (see FIG. 10) centered on the arbor 86 is formed in the date change wheel 81.

Note that in this embodiment when the setting wheel 51, second date change intermediate wheel 52, and date change wheel 81 turn in the forward direction, force works in the direction releasing engagement of the date change wheel 81, and when these wheels turn in the reverse direction, force works in the direction engaging the date change wheel 81.

The date change pawl disc 82, or calendar change pawl, is disposed on the face side of the date change wheel 81, and is substantially disc shaped. The date change pawl disc 82 includes a pawl 821 protruding from the outside surface, and an engagement hole 822.

As shown in FIG. 6, the date indicator 25 has 31 teeth 251 on the inside circumference side, and with each revolution of the date change pawl disc 82, the pawl 821 advances the teeth 251 one tooth. As a result, the date indicator 25 turns the amount of one day, and the number on the date indicator 25 visible through the date window 12A advances one.

The date change cam 83, or calendar change cam, is disposed to the back cover side of the date change wheel 81, and is formed in a fan shape centered on the arbor 86. The date change cam 83 has a stud 831 protruding from face side, and the stud 831 is inserted through the arc-shaped opening 811 in the date change wheel 81, engaging the engagement hole 822 in the date change pawl disc 82.

The date change lever 84, or calendar change lever, is flexible and pivotably disposed to the pin 322 of the main plate 32 (see FIG. 7). The distal end 841 of the date change lever 84 (see FIG. 9) contacts the side of the date change cam 83, and has two protrusions 842, 843 on the side that contacts the date change cam 83.

Date Change Operation

Figure 10:
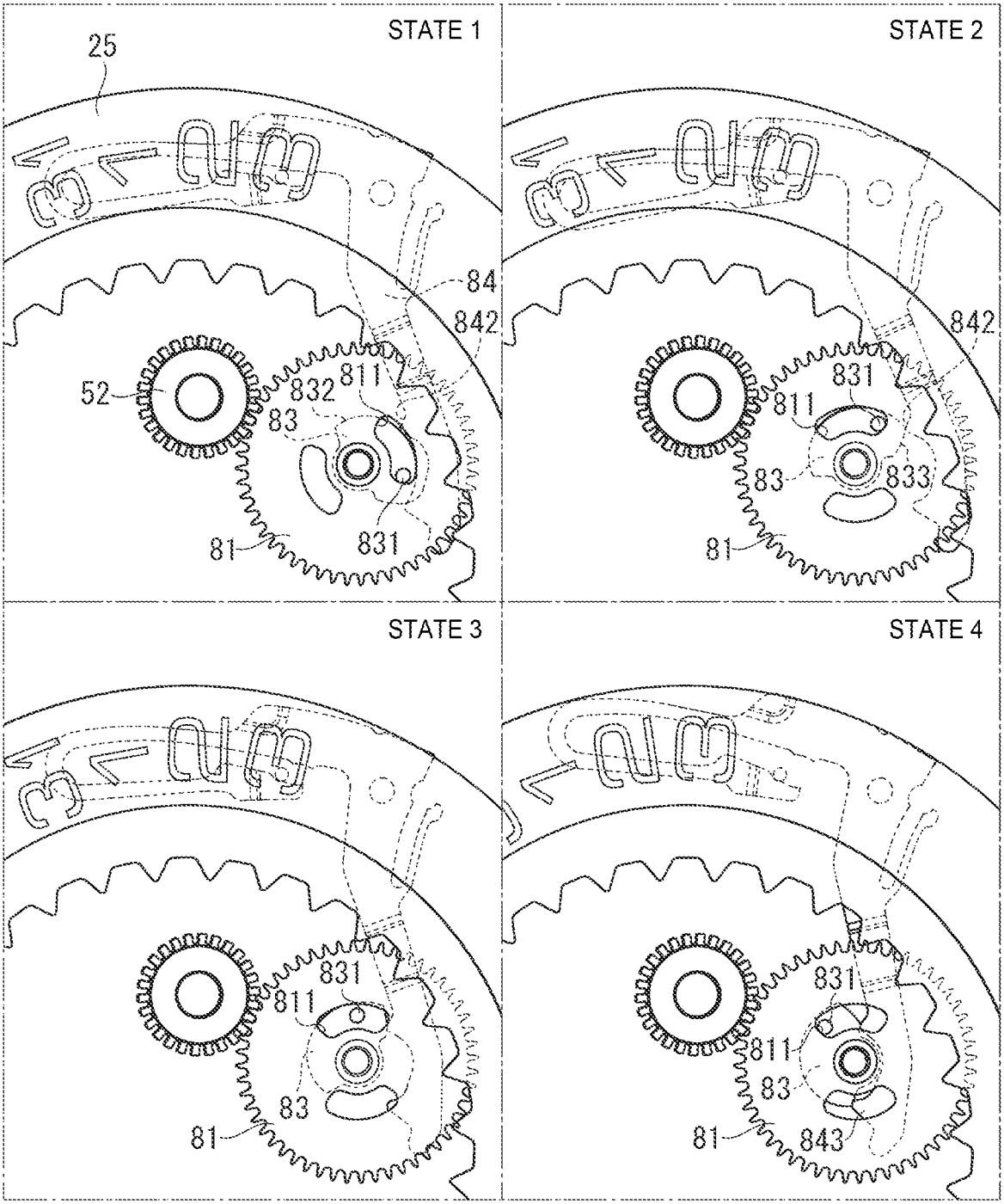
FIG. 10 illustrates the date change operation of a preferred embodiment of the invention.
Figure 11:
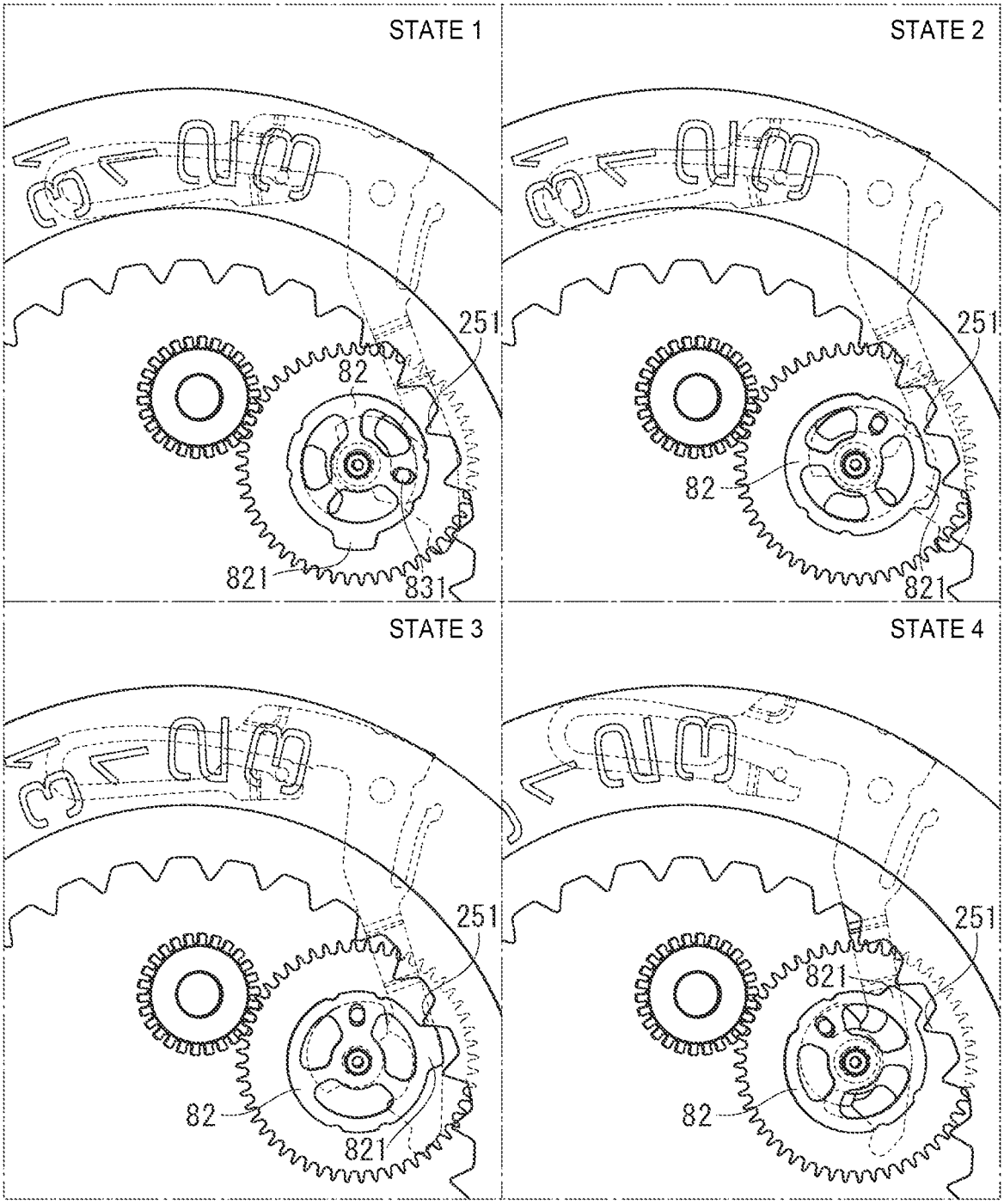
FIG. 11 illustrates the date change operation of a preferred embodiment of the invention.

FIG. 10 and FIG. 11 are state diagrams illustrating the date change operation. Note that the date change pawl disc 82 is not shown in FIG. 10.

Before the date is advanced, protrusion 842 of the date change lever 84 is in contact with the arc 832 of the outside surface of the date change cam 83 as shown in state 1 in FIG. 10 and FIG. 11. At this time, the pawl 821 of the date change pawl disc 82 is not touching the teeth 251 of the date indicator 25.

When the date change wheel 81 then turns counterclockwise in conjunction with the second date change intermediate wheel 52, the stud 831 of the date change cam 83 is pushed by the inside surface of the arc-shaped opening 811 in the date change wheel 81, and the date change cam 83 turns. As a result, the arc 832 of the date change cam 83 pushes protrusion 842 of the date change lever 84, causing the date change lever 84 to gradually flex. The date change pawl disc 82 also turns counterclockwise in unison with the date change cam 83. The date change wheel 81 causes the date change lever 84 to flex for approximately one revolution.

As the date change cam 83 continues turning, as shown in state 2 in FIG. 10 and FIG. 11, the arc 832 of the date change cam 83 stops contacting the protrusion 842 of the date change lever 84, the urging force of the date change lever 84 then causes the protrusion 842 of the date change lever 84 to push the outside radial face 833 of the date change cam 83, and the date change cam 83 jumps rotationally in the counterclockwise direction. More specifically, the date change cam 83 turns at a faster speed than the date change wheel 81. Because the stud 831 of the date change cam 83 moves inside the arc-shaped opening 811 of the date change wheel 81 at this time, rotation of the date change cam 83 is not restricted by the date change wheel 81. The date change pawl disc 82 also turns quickly counterclockwise in unison with the date change cam 83.

When the date change cam 83 turns a specific angle, as shown in state 3 in FIG. 10 and FIG. 11, the pawl 821 contacts the teeth 251 of the date indicator 25, the date indicator 25 is pushed by the pawl 821 and turns counterclockwise one tooth, and the date visible from the date window 12A in the dial 12 is advanced one.

As the date change cam 83 continues turning, as shown in state 4 in FIG. 10 and FIG. 11, the stud 831 of the date change cam 83 contacts the inside face on the opposite side of the arc-shaped opening 811 in the date change wheel 81, and rotation of the date change cam 83 stops. Because the date change cam 83 contacts protrusion 843 of the date change lever 84 at this time, rotation of the date change cam 83 is also stopped by the date change lever 84.

By being advanced by the date change pawl disc 82, the date indicator 25 wants to continue turning counterclockwise due to inertia even after the date indicator 25 loses contact with the pawl 821 of the date change pawl disc 82, but the date indicator 25 is prevented from turning more than one day by the tooth 251 clockwise adjacent to the tooth 251 of the date indicator 25 that is advanced by the pawl 821 of the date change pawl disc 82.

In this way, the date indicator driver 80 can instantly advance the date indicator 25 one day from state 2 to state 4 in FIG. 10 and FIG. 11 due to the restoring force of the date change lever 84 turning the date change cam 83. More specifically, the number on the date indicator 25 visible from the date window 12A changes instantly.

The date change mechanism 50 may therefore also be called an instant date change mechanism. As a result, the user can reliably see the date on the date indicator 25 in the date window 12A immediately before and after the date changes at 12:00 p.m.

Configuration of the Time Difference Correction Mechanism

As shown in FIG. 3 and FIG. 7, the time difference correction mechanism 60 includes a sliding pinion 62 (see FIG. 3) disposed to the winding stem 39; a first intermediate setting wheel 63 (see FIG. 3) that turns in conjunction with the sliding pinion 62 when the winding stem 39 is set to the first stop; a second intermediate setting wheel 64 that turns in conjunction with the first intermediate setting wheel 63; and a setting wheel 51 that turns in conjunction with the second intermediate setting wheel 64.

The sliding pinion 62, first intermediate setting wheel 63, second intermediate setting wheel 64, and setting wheel 51 thus embody a time difference correction train that turns in conjunction with the winding stem 39.

When the winding stem 39 is pulled out to the first stop and turned axially, the first intermediate setting wheel 63, second intermediate setting wheel 64, and setting wheel 51 turn in conjunction with the sliding pinion 62. As a result, the hour wheel body 74 turns and the hour indicated by the hour hand 23 changes.

The hour jumper pinion 73 turns in unison with the hour wheel body 74 at this time, but as described above, because rotation of the hour jumper 72 is restricted by the minute wheel and pinion 43 engaged with the hour wheel 71, the pawl arms 721B, 722B flex, and engagement of the teeth 731 of the hour jumper pinion 73 with the pawls 721C, 722C is released. The hour wheel body 74 therefore turns while the hour jumper 72 and hour wheel 71 remain stationary. As a result, of the second hand 21, minute hand 22, hour hand 23, and 24-hour hand 24, the hour indicated by the hour hand 23 can be changed.

Note that because the teeth 731 of the hour jumper pinion 73 are disposed at 12 equal intervals, the hour wheel body 74 can be turned a 1-hour distance each time the winding stem 39 is turned and the teeth 731 and pawls 721C, 722C are disengaged. More specifically, the time indicated by the hour hand 23 can be changed in 1-hour increments.

Torque of the Hour Jumper

Because the date change lever 84 of the date change mechanism 50 must be advanced by rotation of the hour wheel body 74, greater torque is required to turn the hour wheel body 74 than in a conventional date change mechanism that does not have a date change lever 84.

Figure 12:
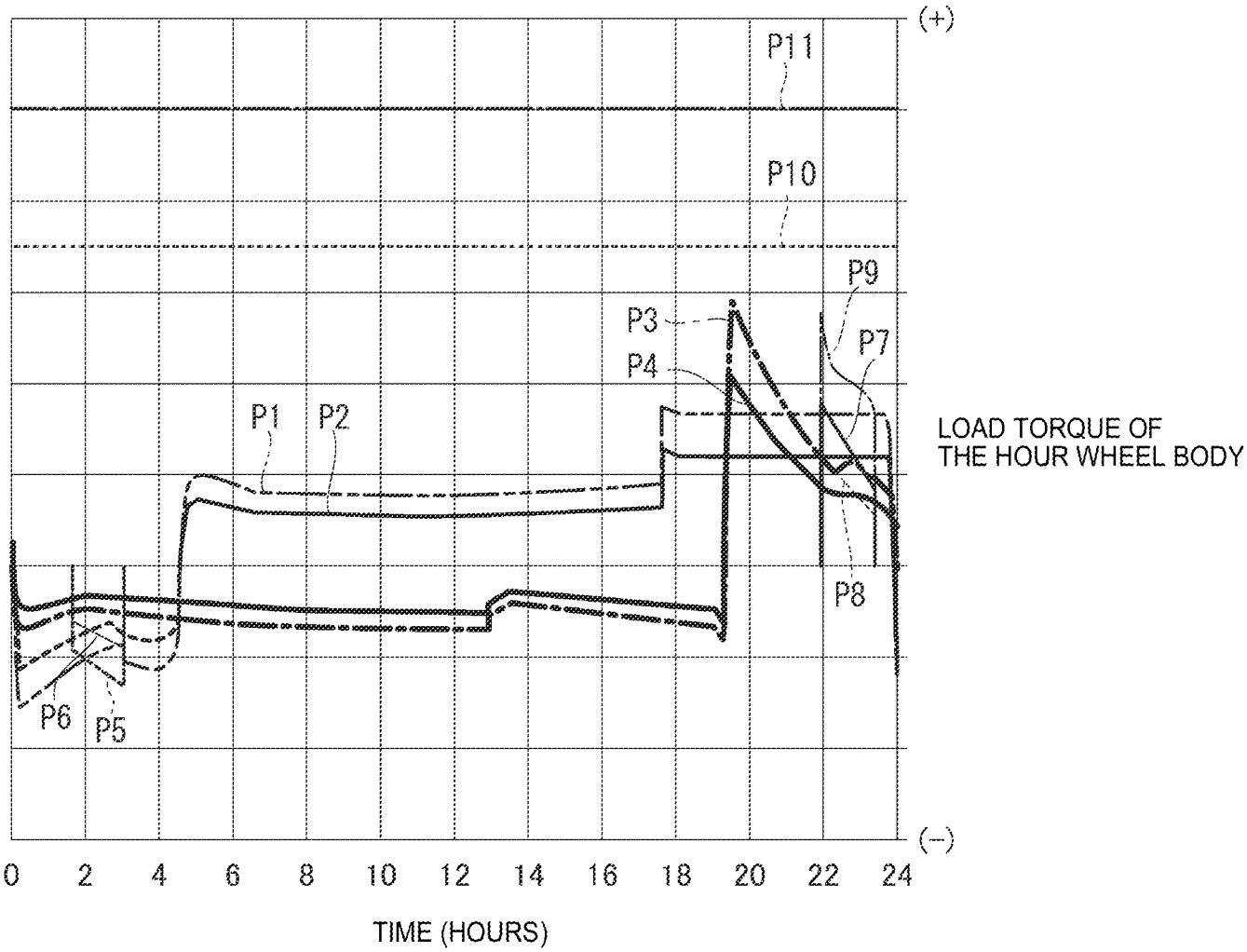
FIG. 12 is a graph of the load torque of the hour wheel body according to a preferred embodiment of the invention.

FIG. 12 is a graph showing the torque required to turn the hour wheel body 74 (load torque) in relation to the time. Dot-dot-dash line P1 shows the maximum load torque (forward rotation) of the date change mechanism 50, and solid line P2 shows the average load torque (forward rotation) of the date change mechanism 50. Dot-dash line P3 shows the maximum load torque (reverse rotation) of the date change mechanism 50, and solid line P4 shows the average load torque (reverse rotation) of the date change mechanism 50.

Dotted line P5 shows the maximum load torque (forward rotation) of the date jumper 87 (see FIG. 6, FIG. 7), and solid line P6 shows the average load torque (forward rotation) of the date jumper 87. Solid line P7 shows the maximum load torque (reverse rotation) of the date jumper 87, and dotted line P8 shows the average load torque (reverse rotation) of the date jumper 87.

Dot-dash line P9 shows the total load torque. Note that FIG. 12 is a graph for when the hour jumper 72 comprises a single hour jumper member. Torque is doubled when the hour jumper 72 comprises two hour jumper members.

As will be understood from FIG. 12, the date change mechanism 50 is configured so that forward rotation requires less torque than reverse rotation.

The dotted line P10 in FIG. 12 shows the minimum torque of the hour jumper 72, and the dot-dash line P11 shows the average torque of the hour jumper 72. The torque of the hour jumper 72 is used to turn the hour wheel body 74, and must therefore be greater than the load torque of the hour wheel body 74. More specifically, the spring force (urging force) of the hour jumper 72 must be greater than the load torque of the hour wheel body 74. As a result, in this embodiment as described above, the hour jumper 72 comprises two hour jumper members 721, 722 to increase the torque, and the minimum torque of the hour jumper 72 indicated by the dotted line P10 is greater than the load torque of the hour wheel body 74 indicated by the lines P1 to P9.

Note that in this embodiment the thickness of the hour jumper 72 (the dimension in the direction aligned with the hand pivots) is set to 1.5 times (or 2 times) or greater than the thickness of the fourth wheel 412, second wheel 422, the hour wheel 71, the hour wheel body pinion 742, and the date change wheel 81.

Operating Effect

In a timepiece 1 according to this embodiment, because the second arbor 331 is disposed between the center pivot 411 of the fourth wheel and pinion 41 and the arbor 421 of the center wheel and pinion 42, contact between the center pivot 411 and the arbor 421 can be suppressed, and rotation of the arbor 421 in conjunction with rotation of the center pivot 411 can be suppressed. In addition, rotation of the arbor 421 in conjunction with rotation of the center pivot 411 due to the lubricant injected between the center pivot 411 and arbor 421 can be suppressed.

Furthermore, because the center pipe 321 is disposed in this timepiece 1 between the arbor 421 and the arbor 741 of the hour wheel body 74 and the hour jumper pinion 73, contact between the arbor 421 and the arbor 741 and hour jumper pinion 73 can be suppressed, and rotation of the arbor 741 and hour jumper pinion 73 in conjunction with rotation of the arbor 421 can be suppressed. In addition, rotation of the arbor 741 and hour jumper pinion 73 in conjunction with rotation of the arbor 421 due to the lubricant injected between the arbor 421 and the arbor 741 and hour jumper pinion 73 can be suppressed.

In addition, rotation of the arbor 421 of the center wheel and pinion 42, and the arbor 451 of the 24-hour wheel and pinion 45, in conjunction with rotation of the arbor 741 of the hour wheel body 74 when correcting the time difference can be suppressed.

Furthermore, because the tubular portion 352 of the date indicator bridge 35 is disposed between the arbor 741 and the arbor 451 of the 24-hour wheel and pinion 45 in this timepiece 1, contact between the arbor 741 and arbor 451 can be suppressed, and rotation of the arbor 451 in conjunction with rotation of the arbor 741 can be suppressed. Rotation of the arbor 451 in conjunction with rotation of the arbor 741 due to the lubricant injected between the arbors can be suppressed.

Rotation of one arbor due in conjunction with rotation of another arbor can thus be suppressed in a timepiece 1 according to this embodiment of the invention.

In this timepiece 1, the guide disposed between the arbor 741 of the hour wheel body 74 and the arbor 451 of the 24-hour wheel and pinion 45 is embodied by a tubular portion 352, which is part of the date indicator bridge 35, there is no need to provide a another part to configure the guide, and the parts count can be reduced.

Furthermore, because this guide is configured by a part of the date indicator bridge 35, the date indicator bridge 35 can be disposed to a position near the hour wheel body 74, and a dial washer 36 can be disposed between the hour wheel body 74 and date indicator bridge 35. This configuration enables suppressing, by means of the dial washer 36, movement of the hour wheel and pinion 70 in the axial direction.

In addition, because the part of the guide 321A that guides the hour wheel body 74 in the center pipe 321, and contact between the hour wheel body pinion 742 and dial washer 36, are on the same plane perpendicular to the axial direction, the hour wheel and pinion 70 can be prevented from tilting while the dial washer 36 suppresses movement of the hour wheel and pinion 70 in the axial direction.

Because the second arbor 331 is disposed to the center wheel bridge 33 in this timepiece 1, another part is not needed to hold the second arbor 331. In addition, because the center pipe 321 is disposed to the main plate 32, there is no need to provide a separate part to hold the center pipe 321. As a result, the parts count can be reduced.

In this timepiece 1, the center pivot 411 of the fourth wheel and pinion 41 is guided by the wheel train bridge 34 and the second arbor 331 disposed to the center wheel bridge 33. As a result, the center pivot 411 can be guided without the fourth wheel and pinion 41 tilting.

Because a dial washer 37 is disposed between the 24-hour wheel 452 and dial 12 in this timepiece 1, movement of the 24-hour wheel and pinion 45 in the axial direction can be suppressed by the dial washer 37. Furthermore, because the part of the tubular portion 352 of the date indicator bridge 35 that guides the 24-hour wheel and pinion 45, and the point of contact between the 24-hour wheel 452 and the dial washer 37, are on the same plane perpendicular to the axial direction, the 24-hour wheel and pinion 45 can be prevented from tilting while the dial washer 37 suppresses movement of the 24-hour wheel and pinion 45 in the axial direction.

In the timepiece 1 described above, the hour jumper 72 is configured from multiple hour jumper members 721, 722. As a result, the torque, that is, the spring force, of the hour jumper 72 can be made greater than when the hour jumper 72 is made from a single hour jumper member.

Even if the hour jumper 72 is made from a single hour jumper member, the spring force can be increased by increasing the thickness of the single hour jumper member. However, if the ratio of the thickness to the width of the pawl arm of the hour jumper member increases, forming the hour jumper member by stamping becomes difficult, and easily manufacturing the hour jumper member may not be possible. However, because there is no need to increase the thickness of the individual hour jumper members 721, 722 in the timepiece 1 according to this embodiment, the hour jumper members 721, 722 can be easily made by stamping, and the hour jumper 72 can be easily manufactured.

In another example, spring force can be increased by changing the plane shape of the single hour jumper member. In this case, however, the force per unit area of the hour jumper pinion 73 increases, wear resistance decreases, and the hour jumper member must be redesigned. In contrast, because the timepiece 1 according to this embodiment maintains wear resistance without changing the force per unit area on the hour jumper pinion 73, and does not require changing the shape of the hour jumper members 721, 722, less time is required to design the hour jumper 72.

Because the timepiece 1 according to this embodiment enables easily increasing the torque of the hour jumper 72, the types of mechanisms that can be driven by the hour wheel body 74 can be increased, and different types of timepieces can be easily manufactured.

The hour jumper members 721, 722 of this timepiece 1 have the same plane shape, size, and thickness. As a result, there is no need to manufacture multiple types of hour jumper members, and the manufacturing process and parts management can be simplified.

The stop position of the hour wheel body 74 when correcting the time difference is determined by the teeth 731 of the hour jumper pinion 73. Therefore, by fixing the hour jumper pinion 73 to the hour wheel body 74, and the hour wheel body 74 turning in unison with the hour jumper pinion 73, the stop position of the hour wheel body 74 can be prevented from shifting more reliably than when the hour wheel body 74 is affixed to the hour jumper 72, and the hour jumper pinion 73 is affixed to the hour wheel 71. As a result, shifting of the position indicated by the hour hand 23 when adjusting the time difference can be reduced.

In the timepiece 1 according to this embodiment, the hour jumper member bodies 721A, 722A of the hour jumper members 721, 722 are guided by the arc member 712 disposed to the hour wheel 71. As a result, the hour jumper members 721, 722 can be reliably positioned by the arc member 712, and the position of the hour jumper members 721, 722 shifting and the torque of the hour jumper 72 changing can be suppressed.

When the winding stem 39 is operated and the time difference correction train turned in this timepiece 1, the hour jumper 72 and hour jumper pinion 73 disengage, and the hour wheel body 74 turns while the hour wheel 71 remains stationary. As a result, the hour indicated by the hour hand 23 can be corrected without changing the hour indicated by the 24-hour hand 24 attached to the 24-hour wheel and pinion 45, which moves in conjunction with the hour wheel 71.

In this timepiece 1, the date change wheel 81 turns in conjunction with the hour wheel body 74, the date change cam 83 turns in conjunction with the date change wheel 81, and the date change lever 84 gradually bends. When the date change cam 83 turns to a specific rotational position, the spring force of the flexed date change lever 84 causes the date change cam 83 to rotate instantly, and the date change pawl disc 82 that turns in unison with the date change cam 83 advances the date indicator 25. As a result, the date can be advanced instantly in a timepiece 1 having this time difference correction function.

Furthermore, because the date change wheel 81 turns in conjunction with the hour wheel body 74 in this timepiece 1, by operating the winding stem 39 to turn the time difference correction train and turn the hour wheel body 74, the date can be adjusted simultaneously to the hour indicated by the hour hand 23, and convenience can be improved compared with a configuration in which adjusting the hour and adjusting the date are done by separate operations.

The thickness of the hour jumper 72 in this timepiece 1 is greater (1.5 times to 2 times greater in this embodiment) than the thickness of the hour wheel 71, for example. This configuration suppresses bending of the hour jumper 72 in the direction perpendicular (the direction aligned with the axial direction of the hour wheel and pinion 70) to the flexing direction of the hour jumper 72 better than in a configuration in which the thickness of the hour jumper 72 is the same as the thickness of the hour wheel 71. More specifically, twisting of the hour jumper 72 can be suppressed. As a result, spring force in the flexing direction of the hour jumper 72 can be stabilized, and the torque of the hour jumper 72 can be stabilized.

By making the thickness of the hour jumper 72 greater than the thickness of the hour wheel 71, the size of the part where the hour jumper 72 and hour jumper pinion 73 engage (the dimension in the axial direction of the hour jumper pinion 73) can be made greater than half the combined thickness of the hour wheel 71 and hour jumper 72. As a result, tilting of the hour jumper 72 and hour wheel 71 when adjusting the time difference can be suppressed better than when the hour jumper 72 and hour wheel 71 are the same thickness.

In this timepiece 1, the date change wheel 81 turns in conjunction with the hour wheel body 74 through the intermediate wheel train (the setting wheel 51 and second date change intermediate wheel 52). Compared with a configuration in which the hour wheel body 74 meshes directly with the date change wheel 81, this configuration increases the number of meshing teeth, and can therefore more easily absorb the force of impact when a sudden shock is applied to the movement 2, for example. As a result, the positions of the hour wheel body 74 and date change wheel 81 shifting when such a force is applied can be suppressed. In addition, the direction of rotation of the date change wheel 81 relative to the direction of rotation of the hour wheel body 74, and the position of the date change wheel 81 relative to the hour wheel body 74, can be adjusted.

In this timepiece 1, the setting wheel 51 is used in the time difference correction train and is also used in the intermediate wheel train of the date change mechanism 50. More specifically, one wheel in the time difference correction train, and one wheel in the intermediate wheel train, are the same wheel. As a result, compared with a configuration in which all wheels of the intermediate wheel train, and all wheels of the time difference correction train, are separate wheels, the number of wheels can be reduced and the parts count can be reduced.

Note that the number of common wheels may also be two or more.

In this timepiece 1, the hour wheel and pinion 70 is disposed on the face side of the main plate 32, and the setting wheel 51, second date change intermediate wheel 52, and date indicator driver 80 are disposed on the face side of the calendar plate 31. In other words, the position of the hour wheel and pinion 70 in the axial direction is determined by the main plate 32, and the positions of the setting wheel 51, second date change intermediate wheel 52, and date indicator driver 80 are determined by the calendar plate 31.

Compared with a configuration in which the setting wheel 51, second date change intermediate wheel 52, and date indicator driver 80 are disposed to the face side of the main plate 32 like the hour wheel and pinion 70, the configuration of this embodiment simplifies positioning the setting wheel 51, second date change intermediate wheel 52, and date indicator driver 80 in the axial direction, and suppresses variation in the position in the axial direction.

Furthermore, because the setting wheel 51, second date change intermediate wheel 52, and date change wheel 81 can be positioned on substantially the same plane, tilting of the wheels can be suppressed when force is applied to the wheels while adjusting the time difference. As a result, by increasing the torque of the hour jumper 72, the force required to turn the hour wheel body 74 when adjusting the time difference is increased, and the time difference can be appropriately adjusted even if the force applied to the wheels increases.

Other Embodiments

The invention is not limited to the embodiments described above, and can be modified and improved in many ways without departing from the scope of the accompanying claims.

Variation 1

Figure 13:
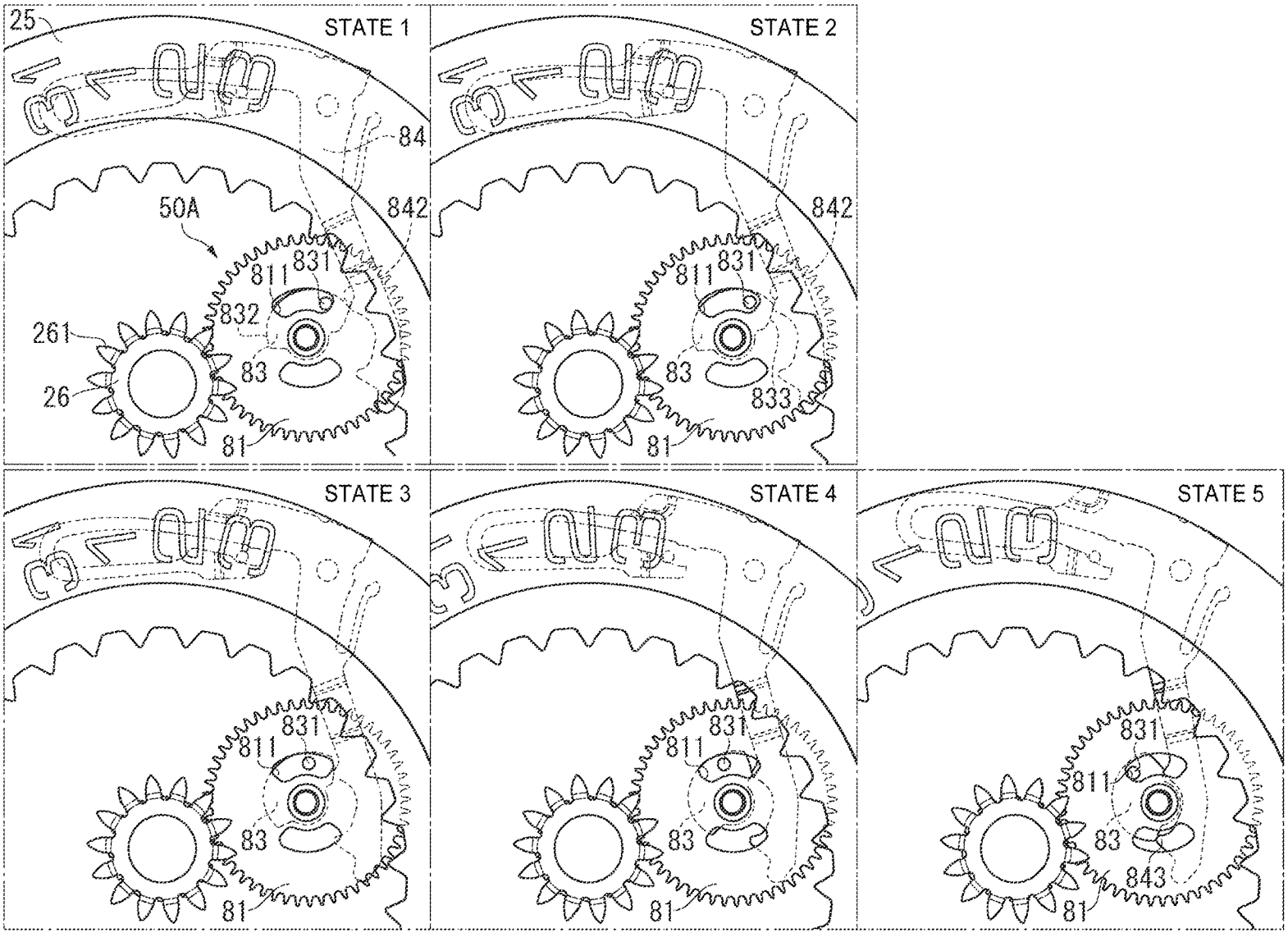
FIG. 13 illustrates the date change operation in another embodiment of the invention.
Figure 14:
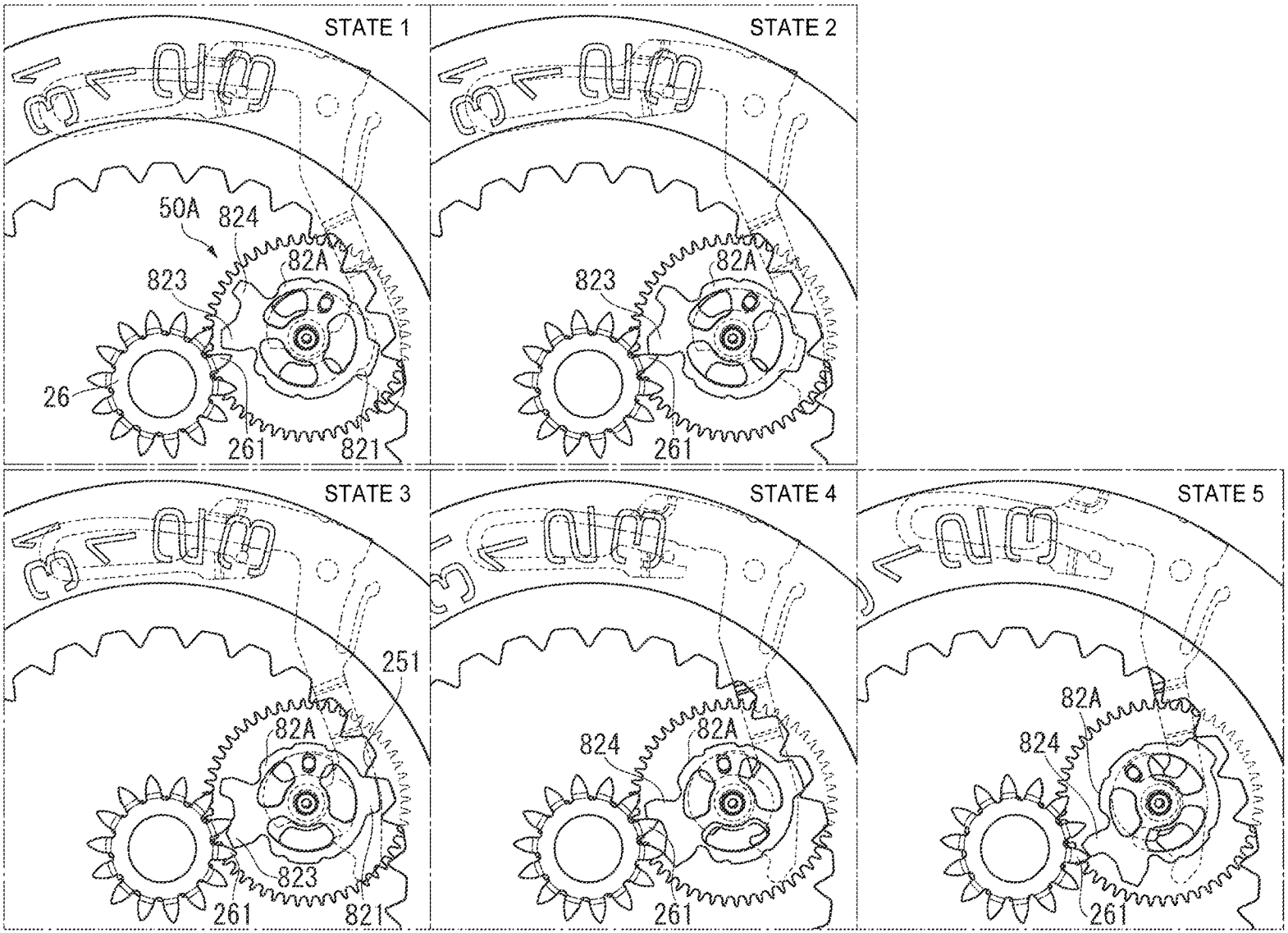
FIG. 14 illustrates the date change operation in another embodiment of the invention.

In the embodiment described above the date change mechanism 50 turns the date indicator 25, but the invention is not so limited. For example, when the timepiece 1 has a day wheel, the day wheel may be turned by the date change mechanism. FIG. 13 and FIG. 14 are state diagrams illustrating the date change operation in this variation. Note that the date change pawl disc 82 is not shown in FIG. 13.

As shown in state 1 in FIG. 14, the date change pawl disc 82A of the date change mechanism 50A in this variation has, in addition to pawl 821, two pawls 823, 824 for advancing the teeth 261 of a day wheel 26 disposed to a day indicator. The day wheel 26 has 14 teeth 261. As a result, the day is advanced one day when the day wheel 26 is advanced two teeth.

As described in the foregoing embodiment, before the day is advanced, the date change cam 83 turns counterclockwise in conjunction with the date change wheel 81, and the arc 832 of the date change cam 83 pushes the protrusion 842 of the date change lever 84, gradually causing the date change lever 84 to flex.

As the date change cam 83 continues turning, as shown in state 1 in FIG. 13, the arc 832 of the date change cam 83 stops contacting the protrusion 842 of the date change lever 84, the restoring force of the date change lever 84 then causes the protrusion 842 of the date change lever 84 to push the outside radial face 833 of the date change cam 83, and the date change cam 83 jumps rotationally in the counterclockwise direction.

Because the stud 831 of the date change cam 83 moves inside the arc-shaped opening 811 of the date change wheel 81 at this time, rotation of the date change cam 83 is not restricted by the date change wheel 81. The date change pawl disc 82 also turns quickly counterclockwise in unison with the date change cam 83.

When the date change cam 83 turns a specific angle, as shown in state 2 in FIG. 13 and FIG. 14, pawl 823 contacts a tooth 261 of the day wheel 26, the day wheel 26 is pushed by the pawl 823 and turns counterclockwise one tooth.

As the date change pawl disc 82A turns further, as shown in state 3 in FIG. 13 and FIG. 14, pawl 821 contacts the teeth 251 of the date indicator 25, the date indicator 25 is pushed by the pawl 821 and turns counterclockwise one tooth (one day).

As the date change pawl disc 82A turns further, as shown in state 4 in FIG. 13 and FIG. 14, pawl 824 contacts a tooth 261 of the day wheel 26, the day wheel 26 is pushed by the pawl 824 and turns counterclockwise one tooth. As a result, the day changes one day.

As the date change pawl disc 82A continues turning, as shown in state 5 in FIG. 13 and FIG. 14, the stud 831 of the date change cam 83 contacts the inside face on the opposite side of the arc-shaped opening 811 in the date change wheel 81, and rotation of the date change cam 83 stops. Because the date change cam 83 contacts protrusion 843 of the date change lever 84 at this time, rotation of the date change cam 83 is also stopped by the date change lever 84.

In this way, as shown by state 2 to state 4 in FIG. 13 and FIG. 14, the date change mechanism 50A can instantly advance the date indicator 25 and the day wheel 26 one day by turning the date change cam 83 by the spring force of the date change lever 84.

Note that the date change mechanism in this first variation describes changing both the date indicator 25 and a day wheel, but the date change mechanism may be configured to turn only a day wheel.

Variation 2

In the embodiment described above, the guide disposed between the arbor 741 of the hour wheel body 74 and the arbor 451 of the 24-hour wheel and pinion 45 is embodied by tubular portion 352, which is part of the date indicator bridge 35, but the invention is not so limited.

For example, the guide may be embodied by part of a date indicator guide bridge that guides the date indicator 25, or by the center pipe or other separately provided part.

Variation 3

In the embodiment described above, the second arbor 331 is disposed to the center wheel bridge 33, and the center pipe 321 is disposed to the main plate 32, but the invention is not so limited.

For example, the second arbor 331 and center pipe 321 may be disposed to a support bridge of the movement 2.

Variation 4

In the embodiment described above the hour jumper 72 is made from two hour jumper members 721, 722, but the invention is not so limited.

More specifically, the hour jumper 72 may be made from three or more hour jumper members according to the torque required to turn the hour wheel body 74. In this case, by making the hour jumper members of the hour jumper 72 to the same plane shape, size, and thickness, the torque of the hour jumper 72 can be increased to 2, 3, 4, or more times the torque of a single hour jumper member by simply increasing the number of hour jumper members, and the torque of the hour jumper 72 can be easily adjusted.

The hour jumper 72 may also be made from a single hour jumper member with greater thickness. If the ratio of the width to the thickness of the pawl arm of the hour jumper member is in the range 0.2 to 0.5, the hour jumper member can be manufactured by a laser or wire cutting process, for example.

The number of hour jumper members in the hour jumper 72 may also differ according to one or more of the plane shape, size, and thickness of each hour jumper member.

For example, by changing at least one of the plane shape, size, and thickness of the pawl arm of each hour jumper member, the torque of the individual hour jumper member can be changed. As a result, the torque of the hour jumper 72 can be adjusted with greater precision than when the plane shape, size, and thickness of the pawl arms are the same.

Furthermore, by changing at least one of the plane shape, size, and thickness of the hour jumper member body of each hour jumper member, the configuration (fastening structure) for attaching the hour jumper member to the hour wheel 71 can be set individually for each hour jumper member.

Variation 5

In the embodiment described above, the hour jumper members 721, 722 of the hour jumper 72 are fastened at the same position when seen from the face side, but the invention is not so limited.

More specifically, the hour jumper members 721, 722 may be secured at different pivot points. In other words, the pawls 721C, 722C may be configured to engage mutually different teeth 731 of the hour jumper pinion 73. For example, hour jumper members 721, 722 may be fastened at pivot points 180 degrees apart. In this case, the center of gravity of the hour jumper 72 can be superimposed with the center of gravity of the hour wheel 71, and tilting of the hour wheel 71 can be suppressed.

The part of the hour jumper pinion 73 that is pushed by the pawls 721C, 722C may also be separated circumferentially. In addition, because the spring force of pawl 721C and the spring force of pawl 722C work in directions cancelling each other, tilting of the hour wheel 71 can be suppressed.

Variation 6

In the embodiment described above, the hour wheel body 74 and the hour jumper pinion 73 are attached, and the hour wheel 71 and hour jumper 72 are attached, but the invention is not so limited.

For example, in another configuration the hour wheel body 74 and the hour jumper 72 may be attached, and the hour wheel 71 and the hour jumper pinion 73 may be attached.

In this case, however, the size of the hour wheel body 74 must be matched to the size of the hour jumper 72, and the size of the hour wheel body 74 increases accordingly. In addition, the size of the date change wheel 81, which turns at half the speed of the hour wheel body 74, must be increased, and the size of the movement 2 increases according.

Furthermore, the hour wheel body 74 is preferably non-metallic because the hour hand 23 is attached. In this case, welding cannot be used to fasten the hour wheel body 74 and hour jumper 72.

Furthermore, because the hour wheel body 74 is not fastened to the hour jumper pinion 73 that determines the stop position of the hour wheel body 74 in the time difference correction operation, the stop position of the hour wheel body 74 can shift when adjusting the time difference.

For the foregoing reasons, the hour wheel body 74 is attached to the hour jumper pinion 73, and the hour wheel 71 is attached to the hour jumper 72, in the embodiment described above.

Variation 7

In the embodiment described above, the second date change intermediate wheel 52 turns in conjunction with the hour wheel body pinion 742 of the hour wheel body 74 through the setting wheel 51, which is part of the time difference correction train, but the invention is not so limited. For example, a configuration in which the second date change intermediate wheel 52 turns in conjunction with the hour wheel body pinion 742 through a separate wheel is conceivable.

Variation 8

In the embodiment described above, the date change wheel 81 turns in conjunction with the hour wheel body pinion 742 through an intermediate wheel train (setting wheel 51 and second date change intermediate wheel 52), but the invention is not so limited. For example, the date change wheel 81 may mesh directly with the hour wheel body pinion 742. In this configuration, the torque required to turn the date change wheel 81 can be reduced.

Variation 9

The embodiment described above describes an example applying the invention to an electronic timepiece, but the invention can obviously also be applied to a mechanical timepiece.

The invention being thus described, it will be obvious that it may be varied in many ways. Such variations are not to be regarded as a departure from the spirit and scope of the invention, and all such modifications as would be obvious to one skilled in the art are intended to be included within the scope of the following claims.

The entire disclosure of Japanese Patent Application No. 2017-184150, filed Sep. 25, 2017 is expressly incorporated by reference herein.

What is claimed is:

1. A timepiece movement comprising:

an hour wheel and pinion;

a minute wheel and pinion;

a winding stem;

a time difference correction train configured to rotate in conjunction with the winding stem;

a calendar indicator; and a calendar change mechanism configured to turn the calendar indicator;

the hour wheel and pinion including an hour wheel configured to rotate in conjunction with the minute wheel and pinion, an hour jumper, an hour jumper pinion that engages the hour jumper, and an hour wheel body to which an hour hand attaches, the hour wheel body configured to turn in conjunction with the hour wheel through the hour jumper and hour jumper pinion, and turn in conjunction with the time difference correction train; and the calendar change mechanism including a calendar change wheel configured to turn in conjunction with the hour wheel body, a calendar change lever, a calendar change cam configured to contact the calendar change lever, flex the calendar change lever by rotating in conjunction with the calendar change wheel, and turn in response to spring force of the flexed calendar change lever, and a calendar change pawl configured to rotate in unison with the calendar change cam, and advance the calendar indicator when the calendar change cam turns in response to the spring force.

2. The timepiece movement described in claim 1, wherein:

the hour jumper flexes perpendicularly to the axis of rotation of the hour wheel and pinion, and the thickness of the hour jumper along the axis of rotation of the hour wheel and pinion is greater than the thickness of the hour wheel along the axis of rotation.

3. The timepiece movement described in claim 1, wherein:

the calendar change mechanism includes an intermediate wheel train with at least one or more wheels that rotate in conjunction with the hour wheel body; and the calendar change wheel turns in conjunction with the hour wheel body through the intermediate wheel train.

4. The timepiece movement described in claim 3, wherein:

at least one wheel of the intermediate wheel train, and at least one wheel of the time difference correction train, are the same wheel.

5. The timepiece movement described in claim 1, further comprising:

a main plate; and a calendar plate disposed on the face side of the main plate;

the hour wheel and pinion being disposed on the face side of the main plate; and the calendar change wheel being disposed on the face side of the calendar plate.

6. A timepiece comprising:

the movement described in claim 1; and an hour hand.

7. The timepiece described in claim 6, further comprising:

a dial with a calendar window;

the calendar indicator being a date wheel; and the number on the calendar wheel visible through the calendar window changing instantly by the calendar change mechanism.

* * * * *